US009863214B2

(12) United States Patent
Cronley

(10) Patent No.: US 9,863,214 B2
(45) Date of Patent: Jan. 9, 2018

(54) MULTI-CIRCULATION VALVE APPARATUS AND METHOD

(71) Applicant: Knight Information Systems, LLC, Lafayette, LA (US)

(72) Inventor: Gerald J. Cronley, Gretna, LA (US)

( * ) Notice: Subject to any disclaimer, the term of this patent is extended or adjusted under 35 U.S.C. 154(b) by 618 days.

(21) Appl. No.: 14/302,507

(22) Filed: Jun. 12, 2014

(65) Prior Publication Data

US 2015/0361764 A1 Dec. 17, 2015

(51) Int. Cl.

| | |
|---|---|
| ***E21B 34/10*** | (2006.01) |
| ***E21B 23/06*** | (2006.01) |
| ***E21B 23/04*** | (2006.01) |
| ***E21B 7/08*** | (2006.01) |
| ***E21B 47/09*** | (2012.01) |
| ***E21B 7/06*** | (2006.01) |
| *E21B 34/00* | (2006.01) |

(52) U.S. Cl.

CPC ..... *E21B 34/10* (2013.01); *E21B 7/061* (2013.01); *E21B 23/04* (2013.01); *E21B 23/06* (2013.01); *E21B 47/09* (2013.01); *E21B 2034/002* (2013.01); *E21B 2034/007* (2013.01)

(58) Field of Classification Search

CPC ..... E21B 34/10; E21B 23/04; E21B 23/06; E21B 7/061; E21B 2034/007; E21B 47/09

See application file for complete search history.

(56) References Cited

U.S. PATENT DOCUMENTS

| | | | | |
|---|---|---|---|---|
| 6,289,999 | B1 * | 9/2001 | Dewey | E21B 23/006 175/232 |
| 2002/0112862 | A1 * | 8/2002 | Patel | E21B 23/006 166/386 |
| 2009/0242211 | A1 * | 10/2009 | Fagley, IV | E21B 23/06 166/374 |
| 2010/0032155 | A1 * | 2/2010 | Darnell | E21B 34/14 166/188 |
| 2013/0233557 | A1 * | 9/2013 | Smith | E21B 34/06 166/305.1 |
| 2014/0008071 | A1 * | 1/2014 | Patterson | E21B 23/006 166/308.1 |
| 2014/0014360 | A1 * | 1/2014 | Wilson | E21B 21/103 166/373 |
| 2014/0345949 | A1 * | 11/2014 | Cramer | E21B 34/10 175/214 |
| 2015/0211318 | A1 * | 7/2015 | Redlinger | E21B 4/02 166/298 |

* cited by examiner

*Primary Examiner* — Blake E Michener

(57) ABSTRACT

A valve apparatus for in a wellbore. The apparatus may include: a housing fluidly connected to a work string, with the housing having an internal portion having a guide pin; a mandrel concentrically disposed within the internal portion of the housing, the mandrel having a piston attached at a first end of the mandrel and a mandrel cap attached at a second end of the mandrel, and wherein the mandrel contains a circulation port and a jet positioned within the piston, the jet operatively configured to receive the fluid and create a pressure drop during fluid flow through the jet; a guide bushing disposed about the mandrel, the guide bushing having a predetermined guide path contained on the guide bushing and wherein the predetermined guide path is operatively associated with the guide pin; and, a spring operatively disposed within the mandrel. A method for setting a down hole tool in a wellbore is also disclosed.

25 Claims, 16 Drawing Sheets

MULTI-CIRCULATION VALVE APPARATUS AND METHOD

BACKGROUND OF THE INVENTION

This invention relates to a valve apparatus for use with a down hole tool. More specifically, but not by way of limitation, this invention relates to an apparatus used to circulate, position and/or orient a down hole tool in a wellbore.

Operators find it necessary to drill wells that are deviated or horizontal in inclination. One technique of drilling deviated or horizontal wells is to place a down hole tool, such as a whipstock assembly, in a well and mill a window from an inclined surface on the whipstock. With this process, the driller will include a measurement while drilling tool in the work string, with the measurement while drilling tool having a suite of sensors which may include azimuth, resistivity, conductivity, etc.

As readily understood by those of ordinary skill in the art, the MWD tool requires circulation of the drilling fluid within the string in order to communicate via the use of pressure pulses. Hence, the orientation of the whipstock can be determined. After determining the position and orientation, the anchor means, which is part of the whipstock assembly, can be hydraulically set within the wellbore. Thereafter, a window in the casing can be milled by a cutter and then the cutter can drill a bore hole into a target formation.

SUMMARY OF THE INVENTION

In a first embodiment, a valve apparatus for circulating fluid in a wellbore filled with fluid is discloses. The valve apparatus is attached to a work string. In this embodiment, the valve apparatus comprises a housing fluidly connected to the work string, the housing having an internal portion having a guide pin, and wherein the internal portion contains a reduced bore and an expanded bore. The apparatus also includes a mandrel concentrically disposed within the internal portion of the housing, with the mandrel having a piston attached at a first end of the mandrel and a mandrel cap attached at a second end of the mandrel, and wherein the mandrel contains a circulation port and a jet member pivotally attached to the piston, with the jet member operatively configured to receive the fluid and create a pressure force during fluid flow through the housing. The valve apparatus may also include a spring lock operatively attached to the jet member, the spring lock engaging the reduced bore of the housing so that the spring lock holds the jet member, a guide bushing disposed about the mandrel, with the guide bushing having a predetermined guide path contained on the guide bushing and wherein the predetermined guide path is operatively associated with the guide pin, with the guide path including a releasing leg. In this embodiment, the spring lock moves into the expanded bore once the releasing leg is reached on the guide path so that the spring lock expands thereby allowing the jet member to pivot so that a continuous flow path is formed. The jet member may comprise an outer shell attached to the piston, an inner shell disposed within the outer shell, and a jet pivotally hinged to the inner shell. Also, the housing may have an internal projection and the internal projection will engage the pivoting jet thereby forming the continuous flow path to the whipstock assembly and the fluid pressure created by the pumps is transmitted to the whipstock assembly. In one embodiment, a collet member disposed about the mandrel may be included, with the collet member having a latch end engaging the piston.

In another disclosed embodiment, a valve apparatus for controlling fluid to a down hole tool in a wellbore is disclosed. The apparatus is attached to a work string and the whipstock assembly is set with fluid pressure. The apparatus comprises a housing fluidly connected to the work string, with the housing having an internal portion containing a guide pin. The apparatus also includes a mandrel concentrically disposed within the internal portion of the housing, with the mandrel having a piston member attached at a first end of the mandrel and a mandrel cap attached at a second end of the mandrel, and wherein the mandrel contains a circulation port. The apparatus may include a nozzle positioned within the piston, with the nozzle operatively configured to receive the fluid pressure and create a pressure drop during fluid flow through the nozzle. The apparatus may also include a guide bushing disposed about the mandrel, with the guide bushing having a predetermined guide path contained on the guide bushing and wherein the predetermined guide path is operatively associated with the guide pin. The apparatus may also comprise a spring operatively disposed about the mandrel, with the spring biasing the mandrel in a forward (i.e. upward) direction.

With this embodiment, the apparatus may contain a lock ring positioned about the mandrel cap, with the lock ring operatively configured to engage an indentation formed on the inner portion of the housing so that once the lock ring expands into the indentation, the lock ring locks the mandrel from movement relative to the housing. Additionally, the mandrel cap contains a track and wherein the internal portion of the housing contains a track pin, and wherein the track and track pin cooperate to allow movement of the mandrel in the forward and reverse direction. Also with this first embodiment, the housing contains a flow aperture and the piston contains a plurality of openings offset from the center axis of the piston member and wherein in the abutting position of the mandrel with an inner bore of the work string, the flow aperture and the plurality of openings forms a continuous fluid path to the down hole tool so that the fluid pressure created by the pumps is transmitted to the down hole tool.

Additionally with the second embodiment, internal seals may be included on the internal portion of the housing that cooperate and engage with an enlarged seal surface on an outer portion of the mandrel for preventing communication from the outer portion of the housing to the internal portion of the housing. An internal seal protector may be fitted about the mandrel for protecting the seals from damage during axial movement of the mandrel. The second embodiment may also include a ball and a ball spring operatively associated with a first end of the guide bushing, with the ball spring biasing the ball into engagement with the first end of the mandrel cap so that the guide bushing is engaged with the mandrel.

A method of positioning and orienting a whipstock assembly in a wellbore filled with fluid is also disclosed. The whipstock assembly may be connected to a work string. The method includes providing an apparatus being connected at a first end to the work string and at a second end to the whipstock assembly. The apparatus includes a housing fluidly connected to the work string, with the housing having an annular port therein; a mandrel concentrically disposed within the internal portion of the housing, and wherein the mandrel contains circulation ports; a spring disposed about the mandrel and biasing the mandrel in a forward (i.e. upward) direction; a guide bushing disposed about the mandrel, with the guide bushing having means for radially rotating the guide bushing. The method further includes placing the work string with attached whipstock assembly in the wellbore and activating a fluid pump at the surface so that the fluid is pumped through the apparatus so that the spring is compressed thereby allowing the mandrel to move in a reverse (i.e. downward) direction so that the circulating port fully aligns with the annular port allowing fluid communication there through.

The method may further include circulating fluid through the circulating ports on the mandrel with the annular ports on the housing, operating a measurement while drilling (MWD) tool located in the work string with the circulation of fluid, and obtaining MWD data measurements from the MWD tool, wherein the MWD measurements are related to the location and position of the whipstock in the wellbore. Next, the method may comprise deactivating the fluid pump so that fluid is no longer pumped, biasing the mandrel with the spring in the forward (i.e. upward) direction so that the circulation port and the annular port are no longer fully aligned, cycling a radial rotating means on the guide bushing, and positioning and orienting the whipstock assembly utilizing the MWD data measurements.

The method may also comprise activating the fluid pump at the surface so that the fluid is pumped through the apparatus so that the spring is compressed thereby allowing the mandrel to move in a reverse (i.e. downward) direction so that the circulating port fully aligns with the annular port allowing fluid communication there through, and obtaining MWD data measurements related to the location and position of the whipstock in the wellbore. The method may also include deactivating the fluid pumps so that fluid is no longer pumped, biasing the mandrel with the spring in the forward (i.e. upward) direction so that the circulation port and the annular port are no longer fully aligned, cycling a radial rotating means on the guide bushing, adjusting the position and orientation of the whipstock assembly utilizing the MWD data measurements, activating the fluid pumps and obtaining MWD data measurement; and reconfirming the position and orientation of the whipstock. In one embodiment, the mandrel contains a pivoting jet member, and the housing contains an internal projection, and the method further comprises forming a continuous flow path to the whipstock assembly by engaging the internal projection with the pivoting jet member so that a continuous flow path is formed.

Also, in one embodiment, the step of cycling a radial rotating means on the guide bushing includes a guide pin on the internal portion of the housing entering a leg on the guide bushing so that the mandrel can expand or retract. Additionally, the apparatus may contain a lock ring and the method would further include expanding the lock ring into an indentation on the internal portion of the housing so that the mandrel is prevented from movement in the forward or reverse direction. Also, in one embodiment, a collet member may be disposed about the mandrel, with the collet member having a latch end engaging the mandrel; the spring operatively disposed within the collet member, wherein the spring biasing the collet member in a direction away from the mandrel; and the method further includes cycling the radial rotating means to a releasing leg on the guide bushing; biasing the mandrel in an upward direction so that the circulating ports on the mandrel are no longer in communication with the annular ports on the housing; releasing the latch end of the collet member from the piston member; mating/abutting the mandrel with the inner bore of the work string so that a continuous flow path to the whipstock is established, and activating the pumps to hydraulically set the whipstock assembly.

Also, the step of cycling the radial rotating means includes engaging a guide pin from the internal housing within radial grooves on the guide bushing and pumping fluid from the surface so that the guide bushing is radially rotated as the guide pin traverses the radial grooves. Additionally, in one embodiment, the step of pumping fluid includes pumping the fluid through a nozzle that is positioned within the piston, with the nozzle operatively configured to create a pressure force during fluid flow through the apparatus and move the mandrel longitudinally along a mandrel axis so that the radial groove follows the guide pin.

DETAILED DESCRIPTION OF THE PREFERRED EMBODIMENTS

Figure 1A:
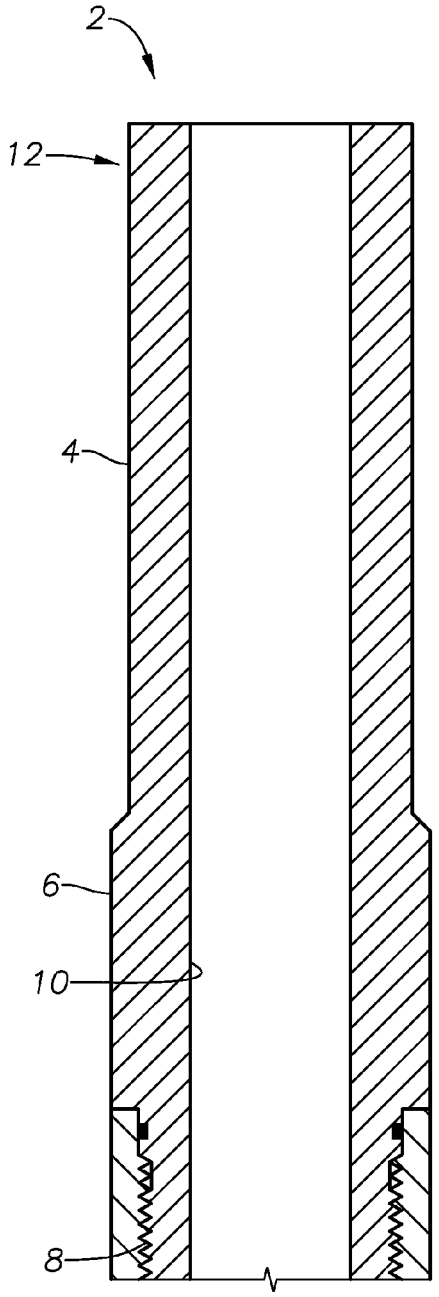
FIGS. 1A-1D are partial cross-sectional views of one embodiment of the present disclosure being run into the wellbore.

Referring collectively to FIGS. 1A-1D, a partial cross-sectional view of one embodiment of the present disclosure will now be described. More specifically, FIGS. 1A-1D illustrate the valve apparatus 2 depicting a first embodiment being run into the wellbore. In this view, the pumps are deactivated. The apparatus 2 includes a top sub 4 that includes an outer portion 6 that extends to external threads 8 which then extends to the inner portion 10. The cylindrical top sub 4 will be connected to a work string (not seen in this figure) at a first end 12 and the second end 14 is connected the upper housing 16. The second end 14 includes a reduced section 17 that has contained therein a central opening 18 as well as the offset bores 20*a*, 20*b*, with the bores 20*a*, 20*b* and opening 18 being in communication with the inner portion 10. The reduced section 17 has extending therefrom the cylindrical walled segment 22 that will also contain openings such as opening 23.

The housing 16 has an outer portion 24 and an inner portion 26. As mentioned earlier, the housing 16 is threadedly connected to the top sub 4 at one end. The external threads 28 of the upper housing 16 are connected to the internal threads 30 of the lower housing 32. The lower housing 32 has an outer portion 34 and an inner portion 36, as well as annular ports there through, seen generally at 38.

The lower housing 32 will be threadedly connected to the bottom sub 40 via external threads 42. As seen in FIG. 1D, the bottom sub 40 has an outer portion 44 and an inner portion 46. The bottom sub 40 will be connected to the whipstock assembly, which will be described later in the disclosure.

An internal mandrel, seen generally at 50, is disposed within the upper housing 16 and lower housing 32. The mandrel 50 includes a piston member 52 at a first end and a mandrel cap 54 at a second end. The piston member 52 contains a flow nozzle 55 for receiving the fluid and creating a pressure differential and force during the fluid flow through the nozzle 55 in order to compress the spring, as will be more fully described. The nozzle 55 may also be referred to as a choke 55, and wherein it is possible to have different size choke (i.e. different size nozzles) which effects the pressure differential created by flow there through.

Figure 1B:
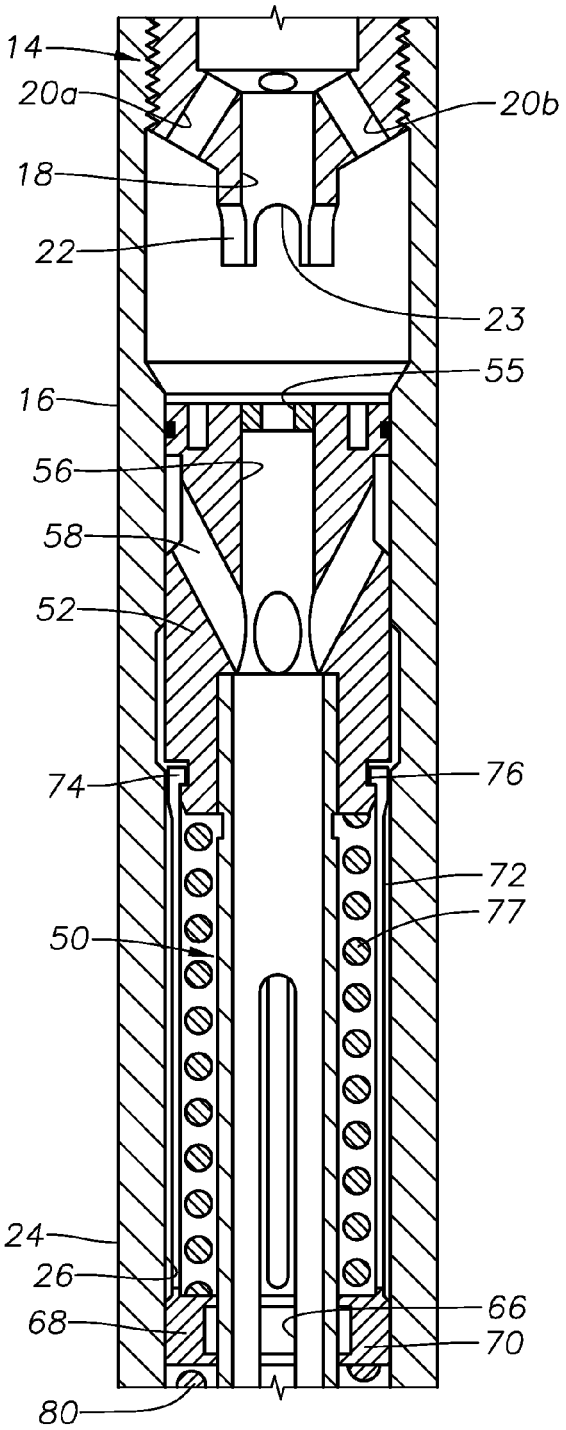

As seen in FIG. 1B, the piston member 52 is threadely connected to the mandrel 50, wherein the piston member 52 contains an inner portion 56 as well as angled opening 58, wherein the opening 58 is angularly offset from the inner portion 56, and wherein the opening 58 that communicates the outer portion of the mandrel 50 with the inner portion 56. A plurality of openings 58 are depicted in FIG. 1B. The mandrel cap 54 contains track 60 in the body and wherein the inner portion 36 of the lower housing 32 has a pin 62 so that the pin 62 engages and follows the track 60 as the mandrel 50 undergoes longitudinal movement during operation.

The mandrel 50 contains circulation ports there through, seen generally at 64, which communicate the outer portion and inner portion of the mandrel 50. In one embodiment, the mandrel 50 also contains the longitudinal slots 66 which cooperate with the collet member 68. The collet member 68 contains a circular head ring portion 70, longitudinal arms 72 extending from the ring portion 70, and releasable latch ends 74 having a lip end. The latch ends 74 are configured to releasably engage a receptacle 76, also referred to as a ledge 76, on the piston member 52. A collet spring 77 is partially disposed about the mandrel 50, wherein the collet spring 77 abuts the piston 52 on one end and the ring portion 70 on the other, and wherein the collet spring 77 biases the latch end 74, and in particular the lip, to release from receptacle 76.

Figure 1C:
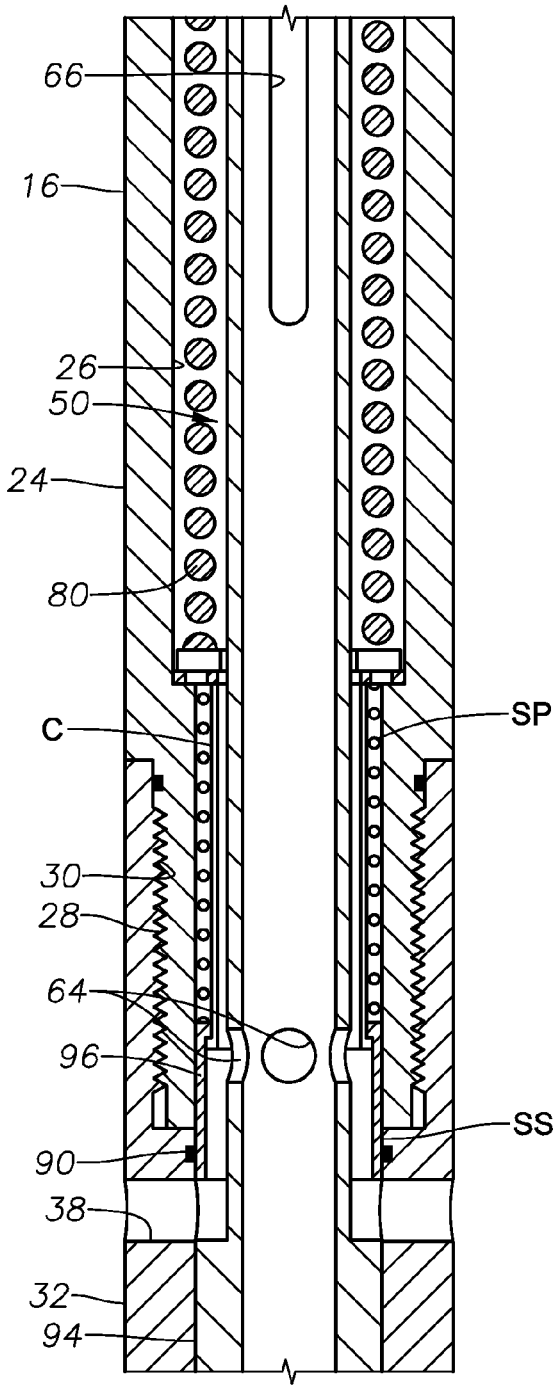
Figure 1D:
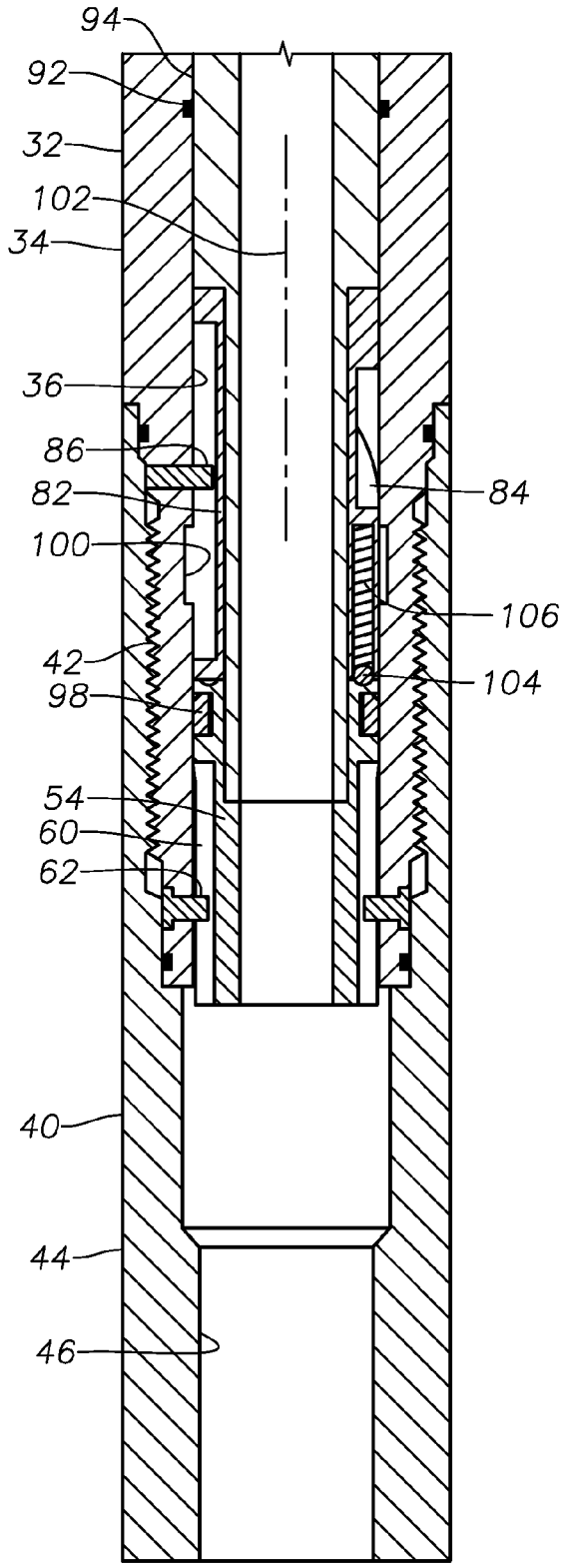
Figure 2A:
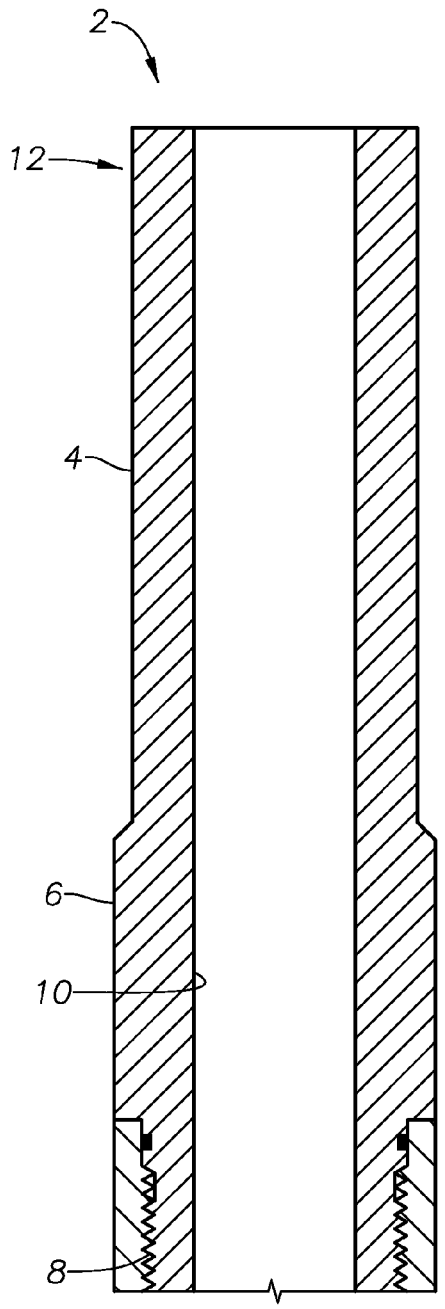
FIGS. 2A-2D are partial cross-sectional sequential views of the embodiment of FIGS. 1A-1D in the circulation mode.
Figure 2B:
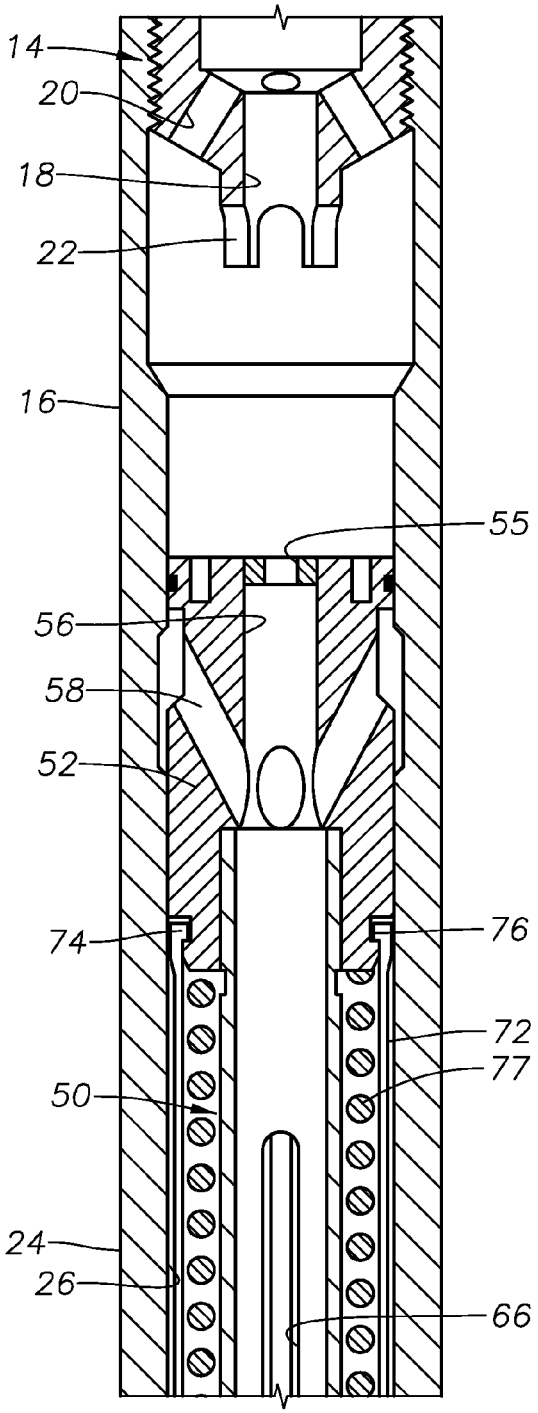
Figure 2C:
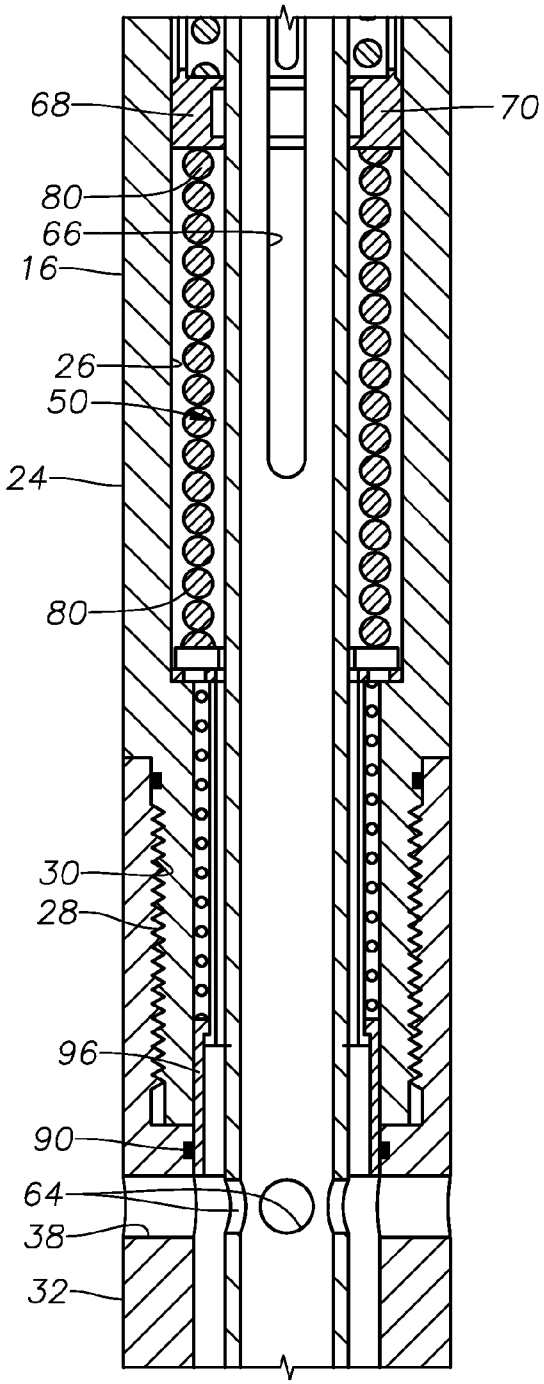
Figure 2D:
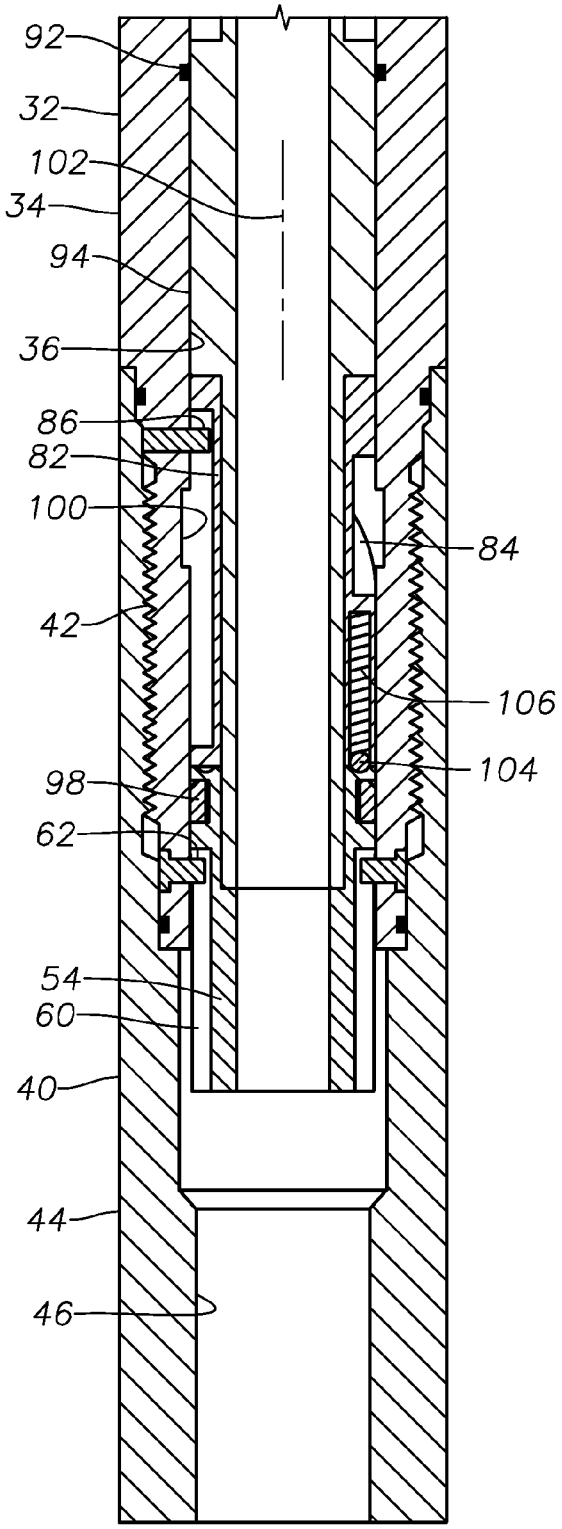
Figure 6A:
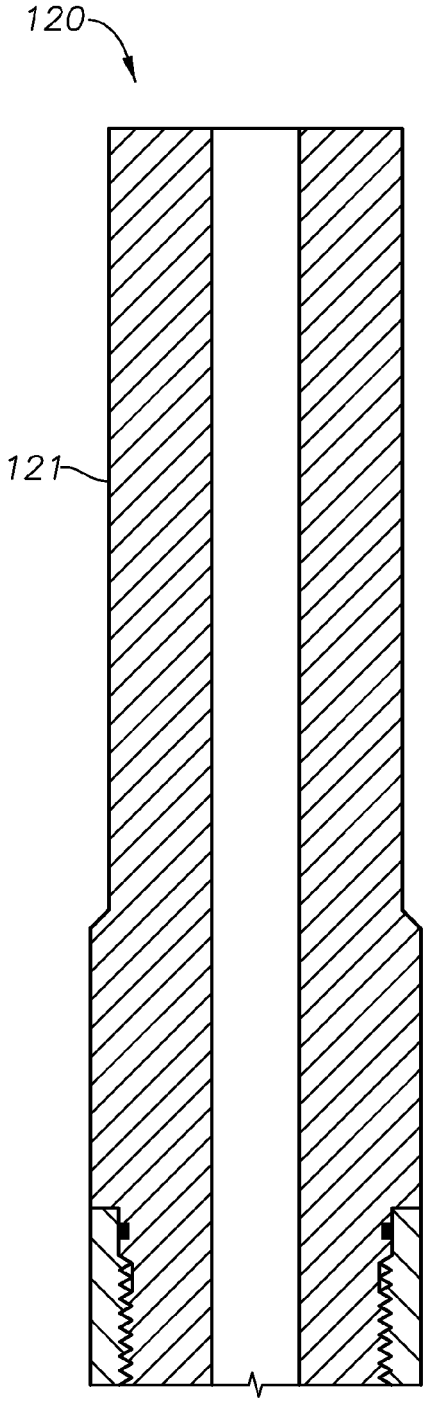
FIGS. 6A-6D are partial cross-sectional sequential views of the second embodiment seen in FIGS. 5A-5D in the circulation mode.
Figure 6B:
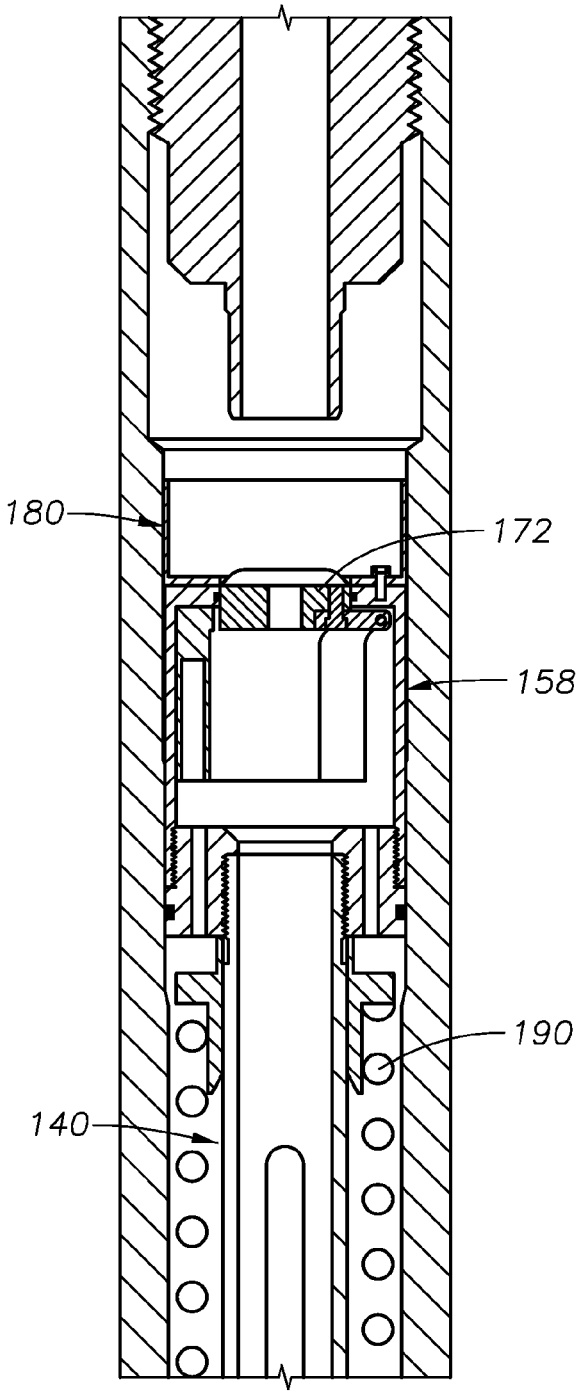
Figure 6C:
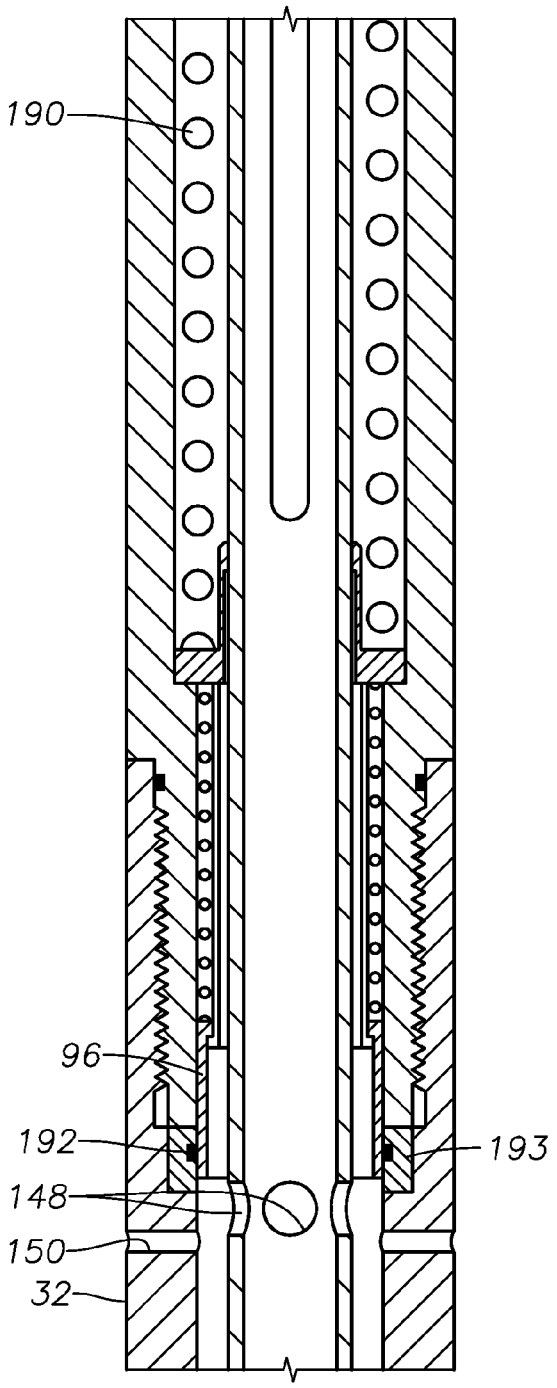
Figure 6D:
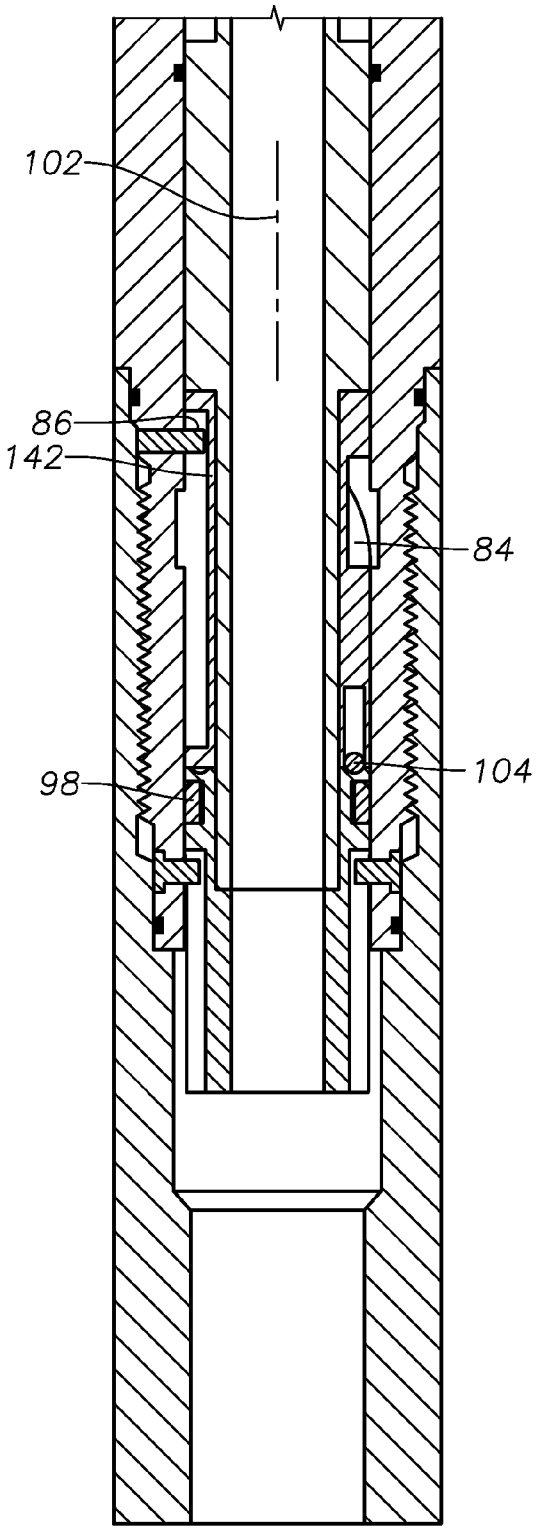

The FIG. 1C also depicts the spring member 80, wherein the spring member 80 will be operatively disposed about the mandrel 50, with the spring member 80 biasing the collet member 68 (FIG. 1B) in a direction towards the piston member 52 so that the spring member 80 biases the mandrel 50 in a forward (i.e. upward toward the surface) direction so that the circulation port 64 is misaligned with the annular port 38. Please note that the collet spring 77 and spring 80 are operatively associated with each other since the collet spring 77 allows the connection of the collet 68 to the piston member 52 while the spring 80 biases the entire mandrel 50; however, once the releasing leg 110*g* (seen in FIG. 6B) is reached in the cycling of a guide bushing 82, the spring 80 will force the mandrel 50 in the forward (i.e. upward) direction which in turn will release the latch end 74 from receptacle 76 due to the force of the collet spring 77.

As seen in FIG. 1D, the guide bushing 82 operatively disposed about the mandrel 50 is illustrated. The guide bushing 82 includes means for radially rotating the guide bushing 82. More specifically, the radially rotating means includes a predetermined guide path 84, which may also be referred to as a track 84, contained on the guide bushing 82, wherein the predetermined guide path 84 is operatively associated with a guide pin 86 so that as the spring member 80 biases the mandrel 50 in a forward and reverse direction, the guide path 84 engages the pin 86 thereby causing the radial and longitudinal movement of the guide bushing 82. In other words, the guide pin 86 traverses the radial groove (path) 84 which in turn results in longitudinal movement of the mandrel 50. As seen in FIG. 1D, the guide pin 86 is set within the housing 32. The guide path 84 will be described in greater detail in the discussion of FIGS. 6A and 6B.

FIGS. 1C and 1D depict the internal seals 90 and 92 that cooperate and engage with the enlarged outer diameter portion 94 of the mandrel 50. Hence, the seals 90, 92 (which may be O-rings) will prevent fluid from communicating with the inner and outer portions of the apparatus 2 when the outer diameter portion 94 is blocking the annular port 38 i.e. in the closed position. The apparatus 2 may also include an O-ring protector assembly 96 (also referred to as the internal seal protector assembly) wherein the O-ring protector assembly 96 protects the O-rings from damage. The internal seal protector assembly is fitted about the mandrel 50 and includes a moveable sleeve SS operatively attached with a collet C, and a spring SP for biasing the sleeve SS to an extended position covering the internal seals.

FIG. 1D further illustrates the lock ring 98 positioned about the mandrel cap 54, with the lock ring 98 operatively configured to engage an indentation 100 formed on the inner portion of the lower housing 32 so that once the lock ring 98 expands into the indentation 100, the lock ring 98 locks and prevents the mandrel 50, along with the guide bushing 82 and mandrel cap 54, from longitudinal movement along an axis 102 of the mandrel 50. Lock rings are commercially available from Knight Oil Tools, Inc. under the name Lock Rings. Additionally, the illustrated apparatus 2 of FIGS. 1A-1D depict a ball 104 operatively associated with a ball spring 106, wherein the ball spring 106/ball 104 are interfaced between the guide bushing 82 and mandrel cap 54. The spring 106 biases the ball 104 engagement with the mandrel cap 54 in order to engage the guide bushing 82 with the mandrel 50.

As noted earlier, the embodiment of FIGS. 1A-1D depict the apparatus 2 with the surface pumps off so that the apparatus 2 with whipstock assembly can be run into the well. In this view, the guide bushing 82 is positioned by the location of the guide pin 86 within the predetermined guide path 84, wherein the specific leg of the guide path 84 determines the amount that spring member 80 will be compressed and locked into place. It should be noted that the apparatus 2 is run into well with the springs 77 and 80 preloaded at the surface. Hence, while circulation port 64 will be in communication with the annular port 38, the ports 64, 38 are offset and not fully aligned.

FIGS. 2A-2D, which are partial cross-sectional sequential views of the embodiment of FIGS. 1A-1D in the circulation mode (i.e. pumps activated), will now be described. In this sequence, the pumps will be turned on so that fluid will flow through the apparatus 2 and in particular through the nozzle 55. The act of flowing fluid through the nozzle 55 will create a force that will act to compress the spring 80 allowing the mandrel 50 to move in a reverse (i.e. downward) direction so that the circulating port 64 is fully aligned with the annular port 38. The circulating of the fluid will allow for operation of a MWD tool and the obtaining of MWD data measurements, wherein the MWD measurements are related to the location and position of the whipstock assembly in the wellbore.

As per the teaching of this disclosure, the deactivation of the pump will cease the flow of fluid through the apparatus 2. Biasing the mandrel 50 with the spring 80 in the forward (i.e. upward) direction results in the circulation port 64 and annular port 38 not being fully aligned, and wherein the whipstock assembly can be positioned and oriented based on the acquired MWD data measurements. In one embodiment, the turning on and off of the pumps will allow the cycling of the guide bushing 82 relative to the guide pin 86 a total of 7 times, wherein in the last cycle, the guide pin traverses the releasing leg, as will be more fully described later.

Generally, the cycling of the guide bushing 82 includes cycling a radial rotating means on the guide bushing 82, activating the fluid pump at the surface so that the fluid is pumped through the apparatus 2 so that the spring 80 is compressed thereby allowing the mandrel 50 to move in a reverse (i.e. downward) direction so that the circulating port 64 fully aligns with the annular port 38, and allowing fluid communication there through. As noted earlier, MWD data measurements related to the location and position of the whipstock in the wellbore is obtained and then the fluid pump is deactivated so that fluid is no longer pumped, the spring 80 moves the piston member 52 of mandrel 50 forward (i.e. upward) and the position and orientation of the whipstock assembly utilizing the MWD data measurements is adjusted if needed and the operator can again activate the fluid pumps, operate the MWD tool and obtain MWD data measurement in order to reconfirm the position and orientation of the whipstock assembly.

Figure 3A:
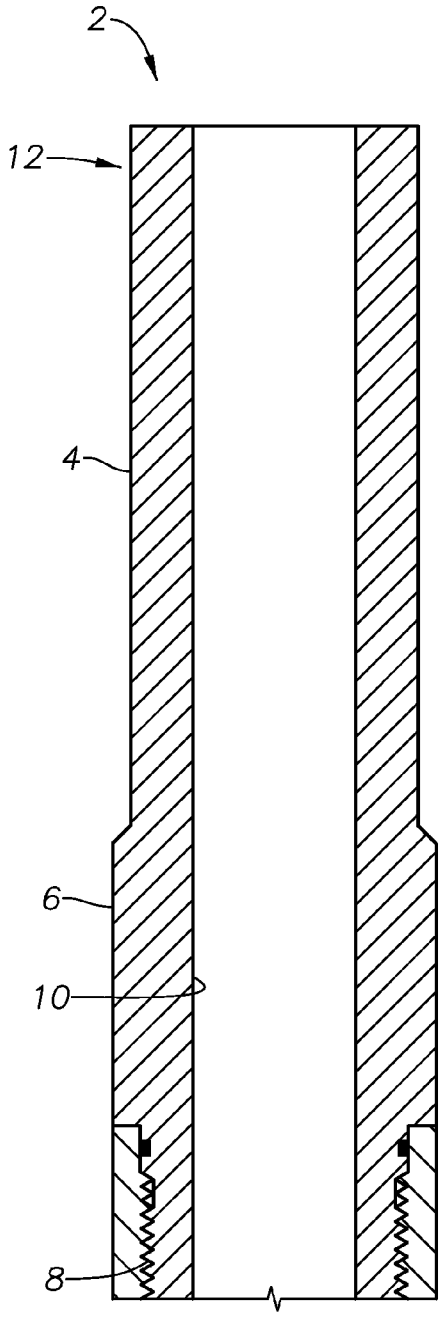
FIGS. 3A-3D are partial cross-sectional sequential views of the embodiment of FIGS. 2A-2D with a continuous flow through bore to hydraulically set the whipstock assembly.
Figure 3B:
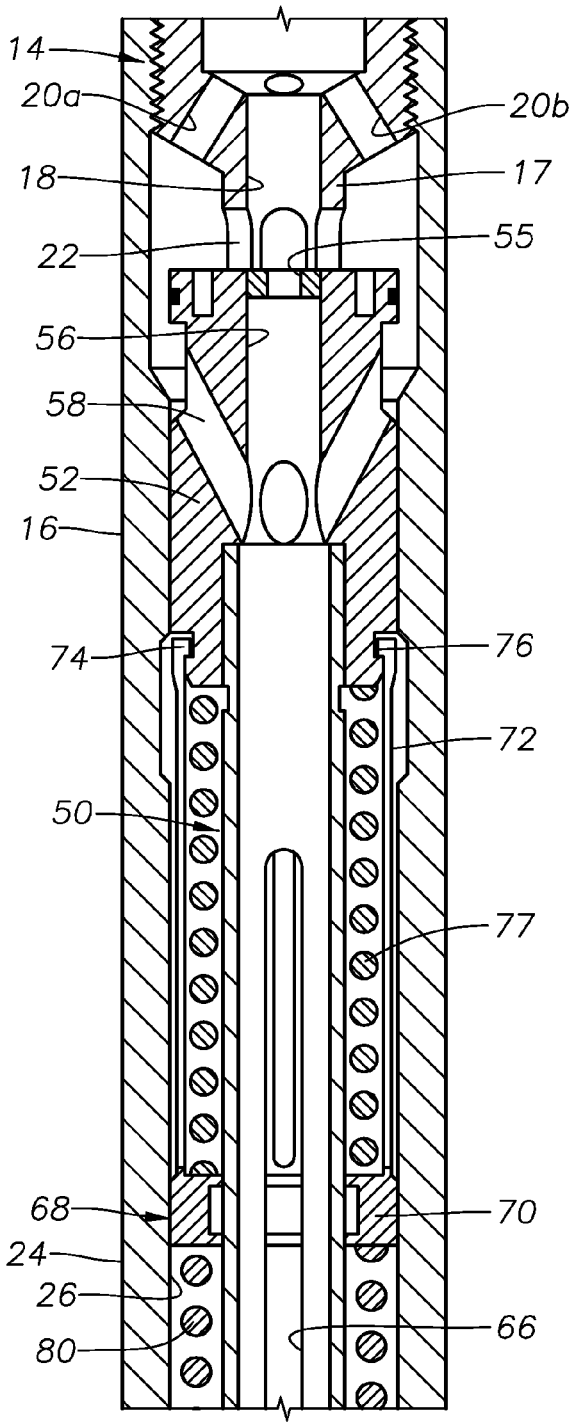
Figure 3C:
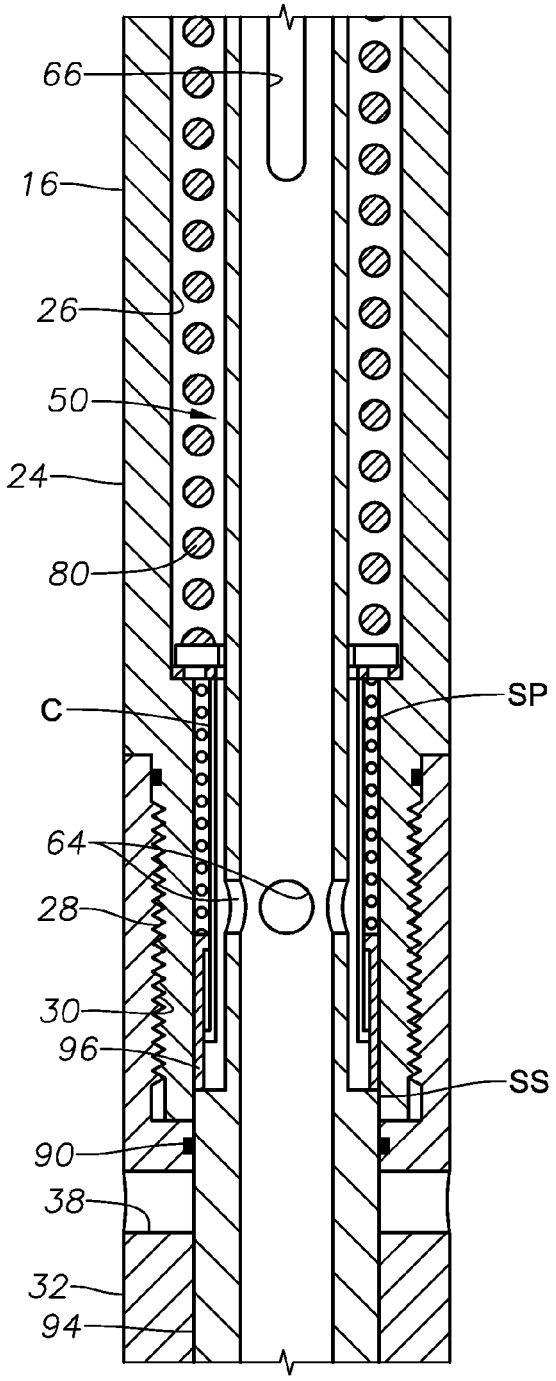
Figure 3D:
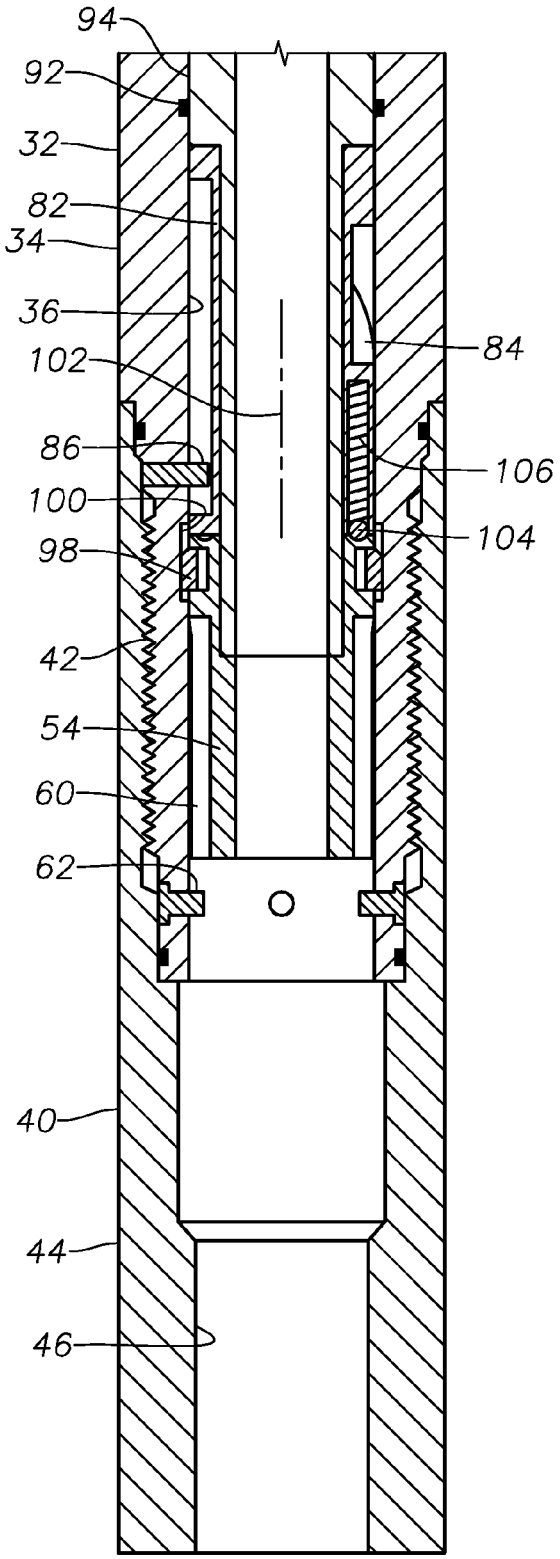

FIGS. 3A-3D, which are partial cross-sectional views of the embodiment of FIGS. 2A-2D, depict the position when the cycling of the guide bushing 82 reaches the releasing leg. More specifically, deactivation of the pump will causes the spring 80 to move in a reverse direction (i.e. downward) as previously noted. Hence, the spring 80 cause the mandrel 50 and collet 68 to move forward thereby moving the piston member 52. The lock ring 98 then expands into the indentation 100 which locks the mandrel 50 into the position seen in FIGS. 3A-3D. As part of this sequence, the step of cycling the radial rotating means on the guide bushing 82 includes the guide pin 86 entering a releasing leg (not seen in this view) on the guide bushing 82, wherein the releasing leg is of sufficient length to enable the mandrel 50 to abut the cylindrical walled segment 22. Hence, as seen in FIG. 3B, a continuous flow through bore to the whipstock assembly and/or down hole tools are formed so that the anchor/packer of the whipstock assembly can be hydraulically set. As seen in FIG. 3D, the pin 86 is in the releasing leg 110*g* as per the cycling of the guide bushing 82.

In the position seen in FIGS. 3A-3D, the internal bore of the apparatus 2 provides a continuous fluid flow path to the whipstock assembly below. As seen specifically in FIG. 3B, the walled segment 22 abuts the piston member 52. The bores 18, 56 and openings 58 provide substantial flow area to the whipstock assembly and/or down hole tools, and an aspect of the present disclosure is the substantial flow area of the apparatus 2 in order to hydraulically set a hydraulic set packer and/or anchor of the whipstock assembly and/or down hole tools in a wellbore.

Figure 4A:
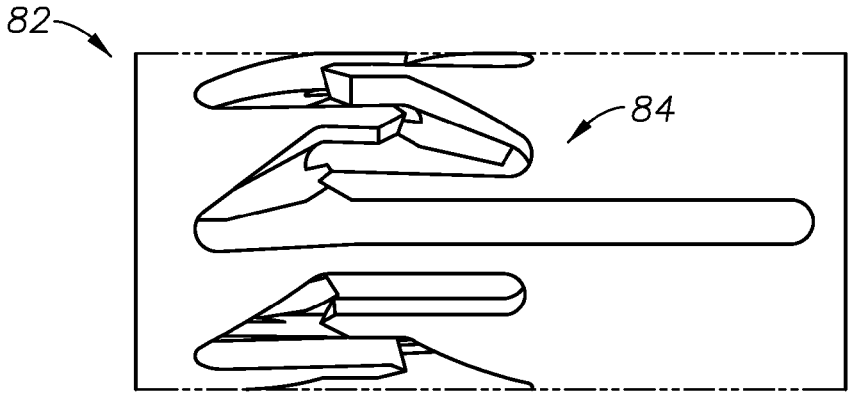
FIG. 4A is an illustration of the one embodiment of the guide bushing of the present disclosure.

FIG. 4A is an illustration of the one embodiment of the guide bushing 82 of the present disclosure. As seen in FIG. 4A, the guide bushing 82 has thereon means for radially rotating the guide bushing 82. In the embodiment of FIG. 4A, the radially rotating means includes a predetermined guide path, seen generally at 84. The guide path 84 is a groove on the cylindrical outer surface of the guide bushing 82 that may be referred to as a J-slot and/or radial groove. As noted earlier, the guide pin 86 will engage within the guide path 84.

Figure 4B:
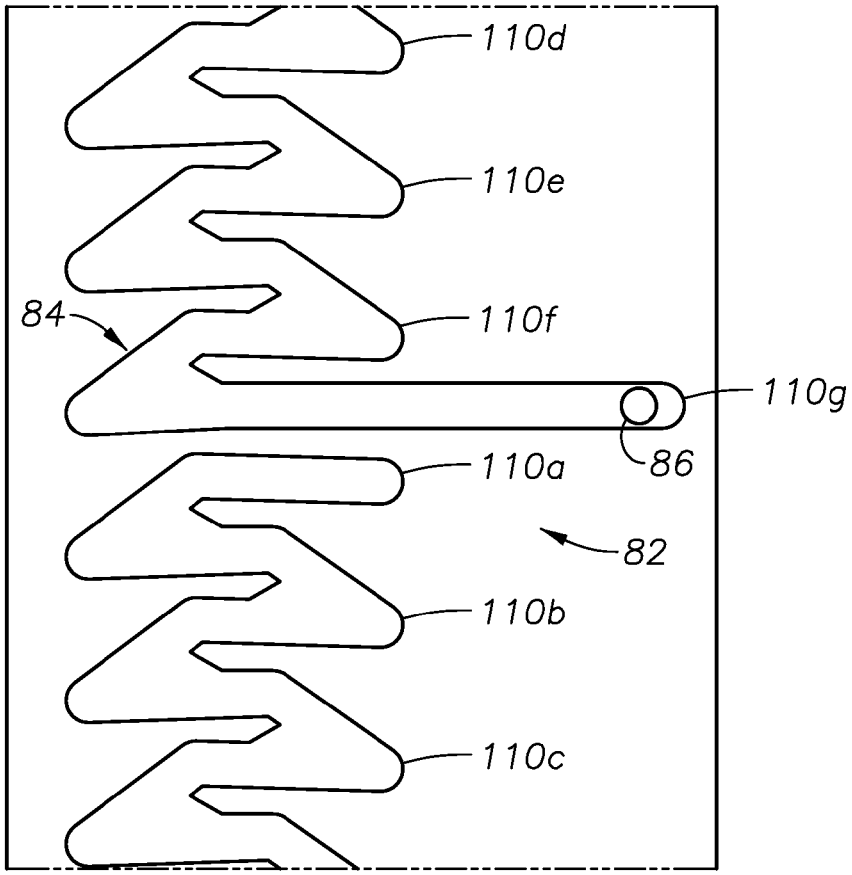
FIG. 4B is an unwrapped view of the guide bushing seen in FIG. 6A.

Referring now to FIG. 4B, an unwrapped view of the guide bushing 82 seen in FIG. 4A is illustrated. As shown, the predetermined guide path 84 will have 7 cycles, which corresponds to 7 legs. The legs include 110*a*, 110*b*, 110*c*, 110*d*, 110*e*, 110*f*, 110*g*. The last leg 110*g* (also referred to as the releasing leg 110*g*) is the longest leg and the length is sized so that the leg 110*g* will traverse most of the length of the guide bushing 82 and the pin 86 will stop the travel at the end of the leg 110*g*, thereby placing the apparatus 2 into the position seen in FIGS. 3A-3D. In other words, at the position seen in FIG. 4B, the guide pin 86 allows the spring 80 to bias the mandrel 50 to the position seen in FIG. 3A-3D, which in turn allows the spring 77 to release the latch end 74 from the receptacle 76, and therefore, forms the continuous flow path for the fluid to be pumped to the anchor/packer of the whipstock assembly, wherein the anchor/packer can be set in the wellbore as previously noted.

Figure 5A:
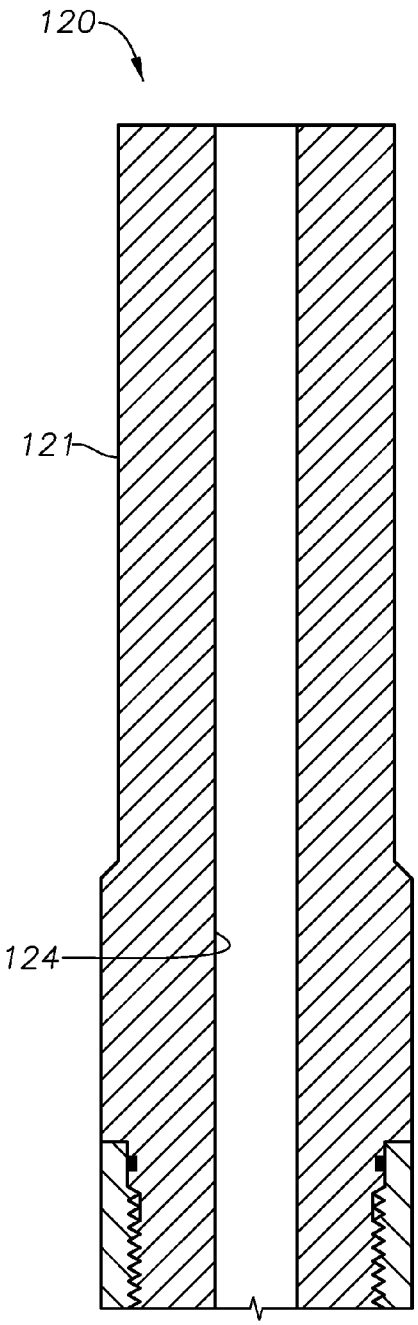
FIGS. 5A-5D are partial cross-sectional views of a second embodiment of the present disclosure being run into the wellbore.
Figure 5B:
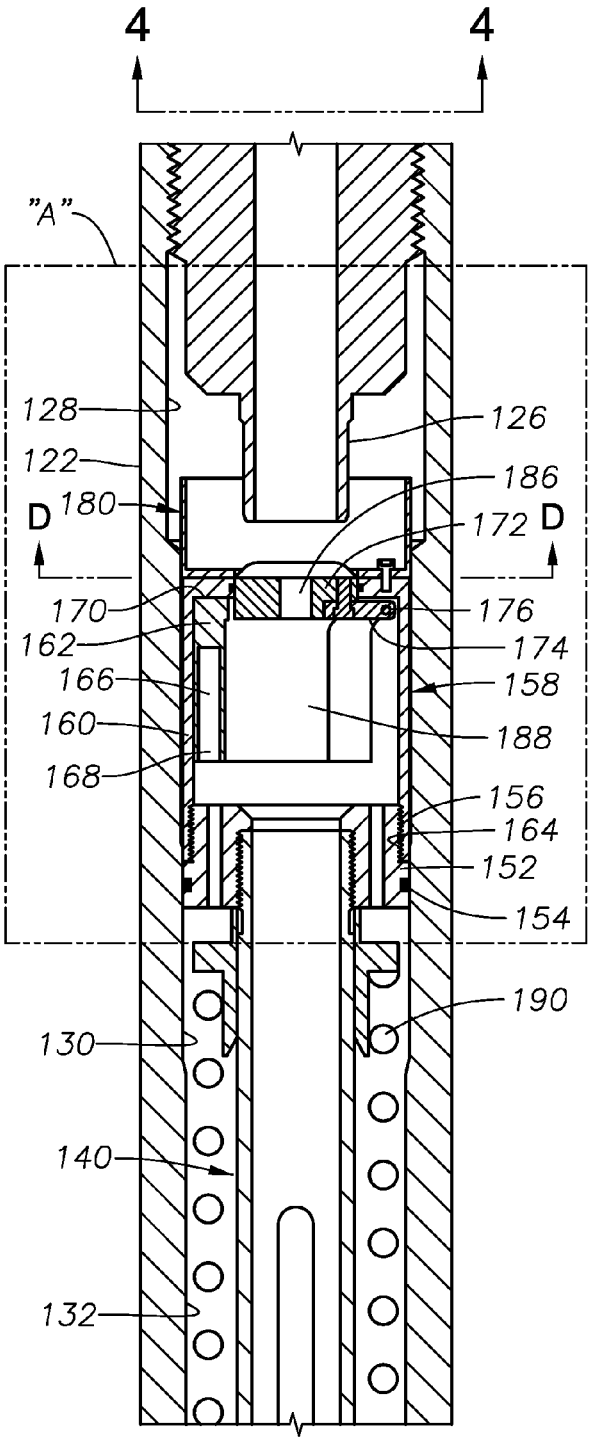
Figure 5C:
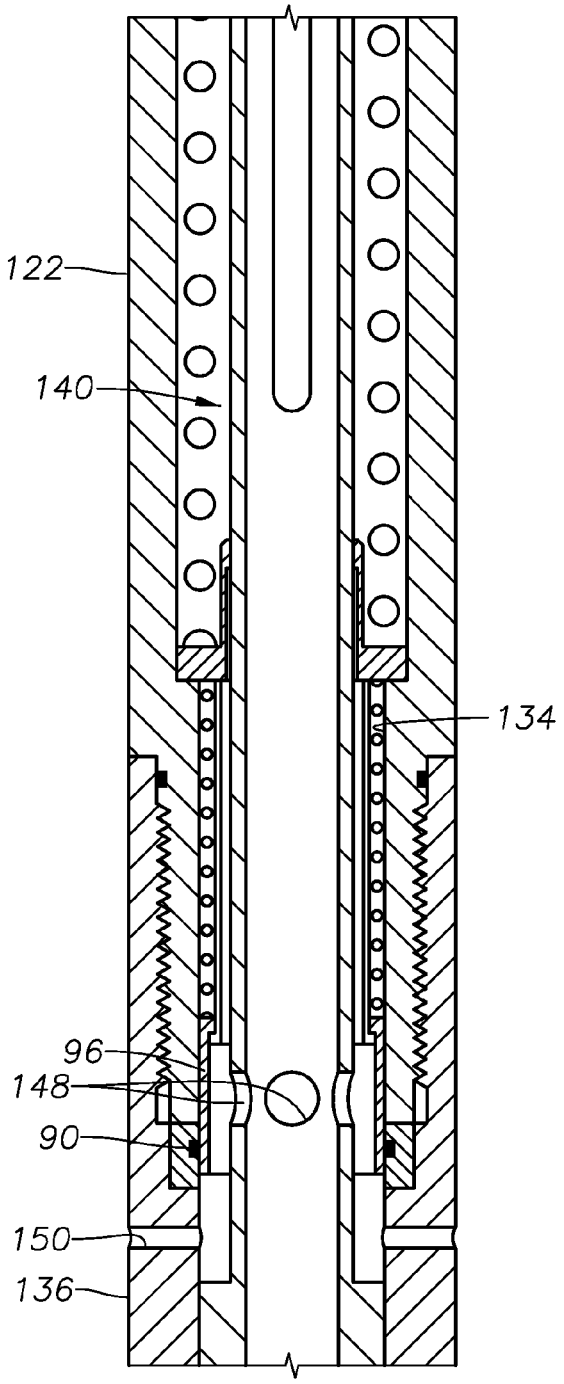
Figure 5D:
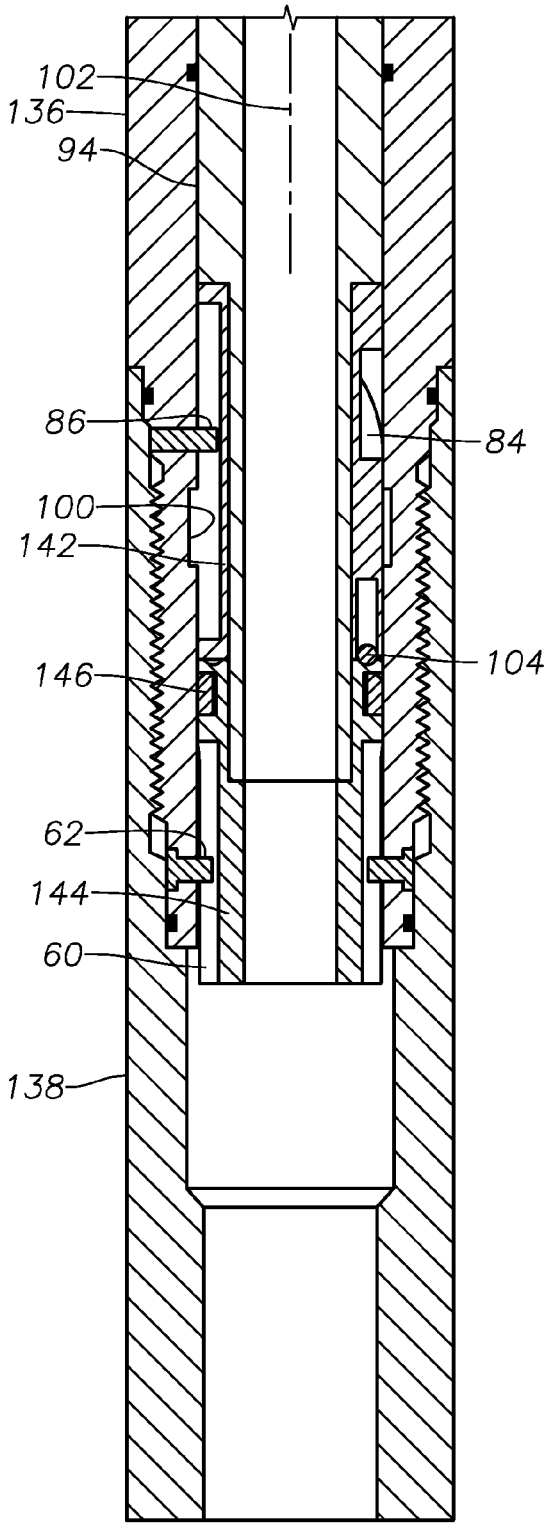

FIGS. 5A-5D are partial cross-sectional views of a second embodiment of the valve apparatus 120 present disclosure being run into the wellbore. In this second embodiment, a pivoting jet is disclosed, as will be more specifically described. As seen in FIGS. 5A-5D, a top cylindrical sub 121 (which is similar to the top sub 4 previously mentioned) is threadedly connected to upper housing 122 (which is similar to the upper housing 16 previously mentioned) with the top sub 121 having an inner portion 124 as well as an internal projection, seen generally at 126 that extends from the top sub 121. The housing 122 has an expanded bore 128 which extends to a reduced bore 130, as well as the internal diameter surface 132 which extends to the next reduced internal diameter surface 134. The housing 122 is threadedly connected to the lower housing 136, and wherein the lower housing 136 will be threadedly connected to the bottom sub 138 (which is similar to the bottom sub 40 previously mentioned). A mandrel 140 is disposed within the valve apparatus 120 (wherein the mandrel 140 is similar to the mandrel 50 previously mentioned). As seen in FIGS. 5A-5D, a guide bushing 142 is disposed about the mandrel 140, and a mandrel cap 144 (which is similar to the mandrel cap 54 previously described) is threadedly attached to the mandrel 140 as seen in FIG. 5D. A lock ring 146 is included (similar to the lock ring 98 previously described). The mandrel 140 includes the circulation port 148 (which is similar to the circulation port 64 previously mentioned) and the lower housing 136 includes the annular port 150 (which is similar to the annular port 38 previously described). In the second embodiment seen in FIGS. 5A-5D, the remainder of the apparatus is the same as the first embodiment identified earlier, and therefore, the description of the remainder of the apparatus will not be repeated. In other words, components such as the guide bushing 142, guide pin 86, mandrel cap 144, lock ring 146, track 60, track pin 62, circulation port 148, and annular port 150 will not be described any further as they are similar to the previously mentioned components of the first embodiment seen in FIGS. 1 through 4.

Figure 8:
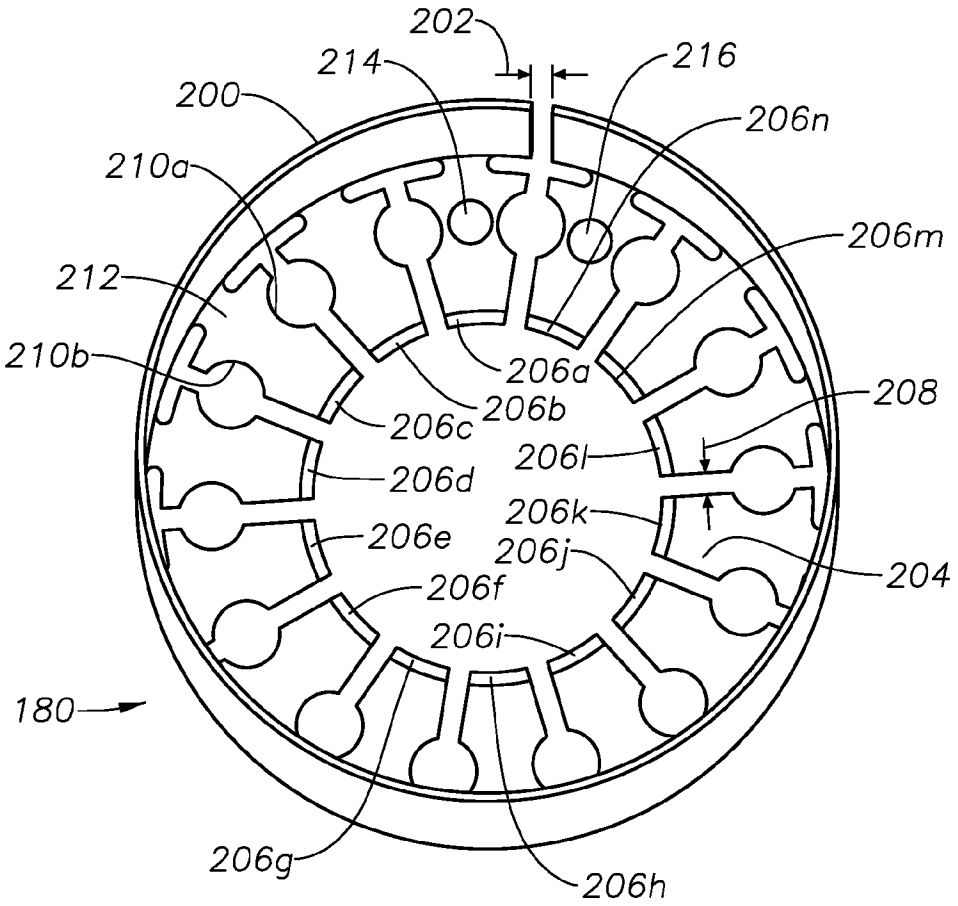
FIG. 8 is a perspective view of one embodiment of the spring lock depicted in FIGS. 5A-5D.

The mandrel 140 will be threadedly attached to the piston 152, and wherein the piston 152 contains an indentation for placement of a seal member 154 for sealingly engaging with bore 130 as well as outer threads 156. Please note that the mandrel 140 and piston 152 may be collectively referred to as the mandrel assembly. The piston 152 will be operatively attached to the jet member, seen generally at 158. The jet member 158 contains an outer shell 160 that has an inner shell 162 disposed therein, and wherein the inner shell 162 is floating within the outer shell 160. The outer shell 160 has inner threads 164 that will engage with the outer threads 156 of the piston. The inner shell 162 contains cavities, such as cavity 166 that has a spring 168 disposed therein. With the spring 168, the inner shell 162 is biased against the surface 170 of the outer shell 160. A pivot jet 172 is hinged to the inner shell 162 via the hinge 174. As shown in FIG. 5A, the hinge 174 has the pin 176 as the pivot point for the pivot jet 172. The inner shell 162 has a cut-out section for placement of the pivot jet 172 (as will be described later in the description). A spring lock 180 is operatively attached to the jet member 158, and more specifically, the spring lock 180 is engaged with the pivoting jet 172. A perspective view of the spring lock 180 is seen in FIG. 8, and wherein the spring lock 180 has a cylindrical wall 200 that extends to a radial surface 204, and wherein the radial surface 204 will engage the pivoting jet 172. Returning to FIGS. 5A-5D, the pivot jet 172 contains an inner bore 186 and the inner shell 162 contains the inner bore 188. The jet inner bore 186 provides a restriction (i.e. the choke) that creates the pressure drop and force required to compress the spring 190 (wherein the spring 190 is similar to the spring 80 previously mentioned). The position of the spring lock 180 relative to the reduced bore 130 and the expanded bore 128 illustrates the position when the spring lock 180 is closed and engaged with the reduced bore 130 by the distance D. In other words, the reduced bore 130, by the distance D, is engaging the spring lock 180 in the closed position and holding the jet 172 so that the jet 172 can create the pressure drop during fluid flow, as seen in FIGS. 5A-5D.

Referring collectively now to FIGS. 6A-6D, a partial cross-sectional sequential view of the embodiment of FIGS. 5A-5D will now be described, and wherein FIGS. 6A-6D depict the apparatus 120 in the circulation mode. As noted earlier in this description, fluid pumps on the surface will be activated which will pump fluid through the work string and through the apparatus 120. More specifically, the fluid will flow through the top sub 121, through the jet 172, through the mandrel 140 and through the circulation port 148 and the annular port 150. The flow through the jet 172 will cause a pressure drop and the created force will compress the spring 190, which in turn will engage the guide path 84 on the guide bushing 142 with the guide pin 86, as previously noted. As seen in FIGS. 6A-6D, the spring lock 180 and attached jet member 158 will travel downward (i.e. away from the surface) as well as traverse the guide path 84. In the circulation mode, the MWD tool may be operated in order to collect MWD data. Other uses of the apparatus in the circulation mode include to circulate the fluid for various well control issues, such as a kick, or to set other down hole tools, such as hangers and packers. Once the pump is deactivated, the mandrel 140, spring lock 180 and jet member 158 return to the position seen in FIGS. 5A-5D for a predetermined number of cycles, i.e. until the releasing leg in the guide path 84 is reached.

Figure 7A:
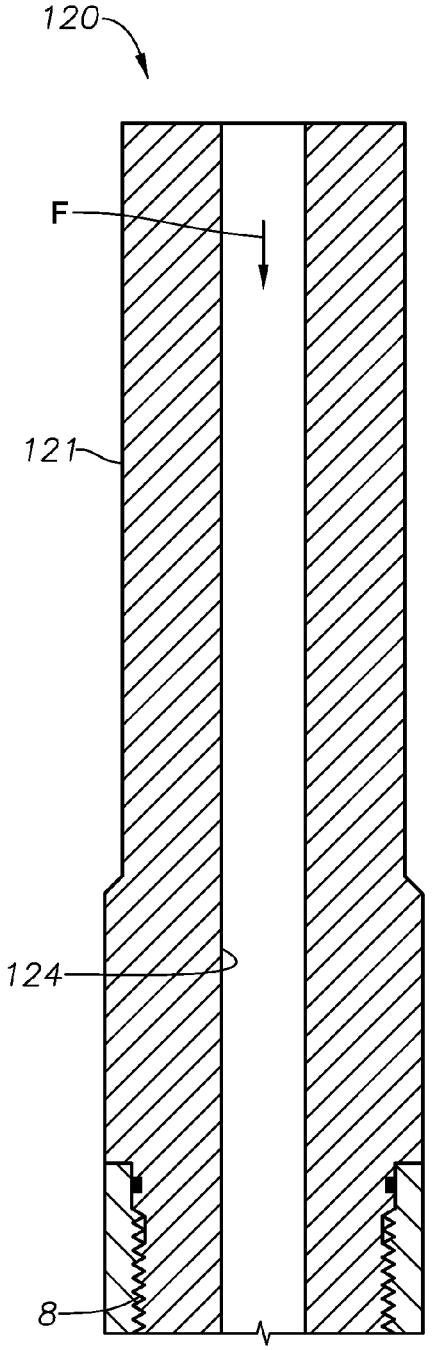
FIGS. 7A-7D are partial cross-sectional sequential views of the second embodiment seen in FIGS. 6A-6D with a continuous flow through bore to hydraulically set the whipstock assembly.
Figure 7B:
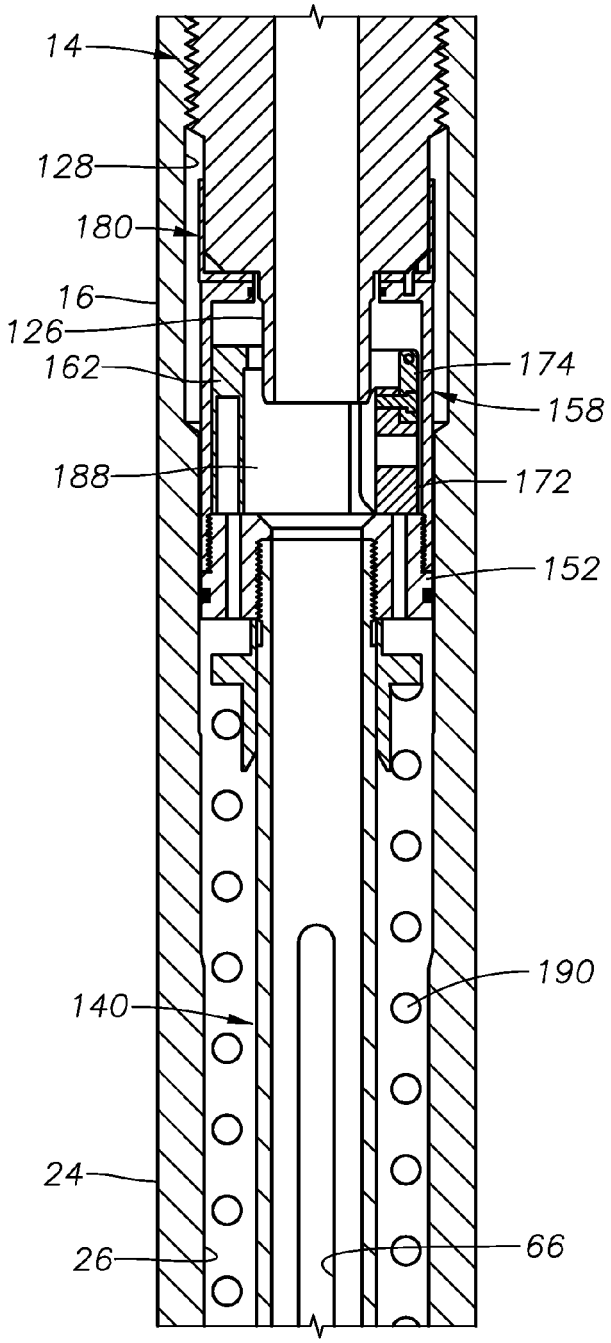
Figure 7C:
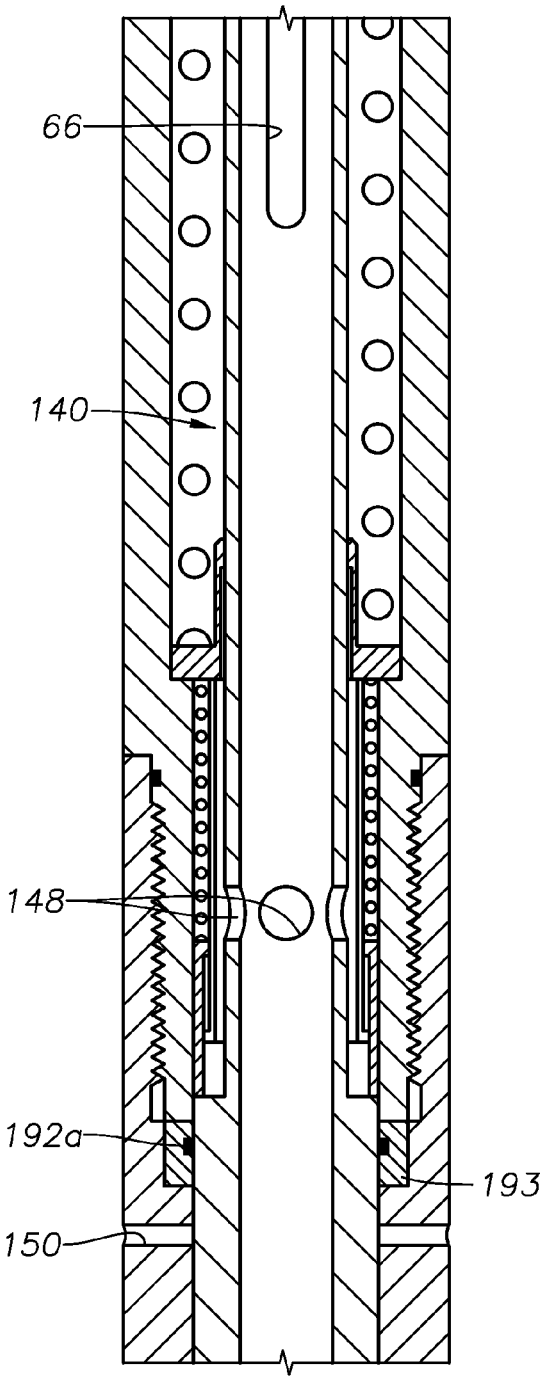
Figure 7D:
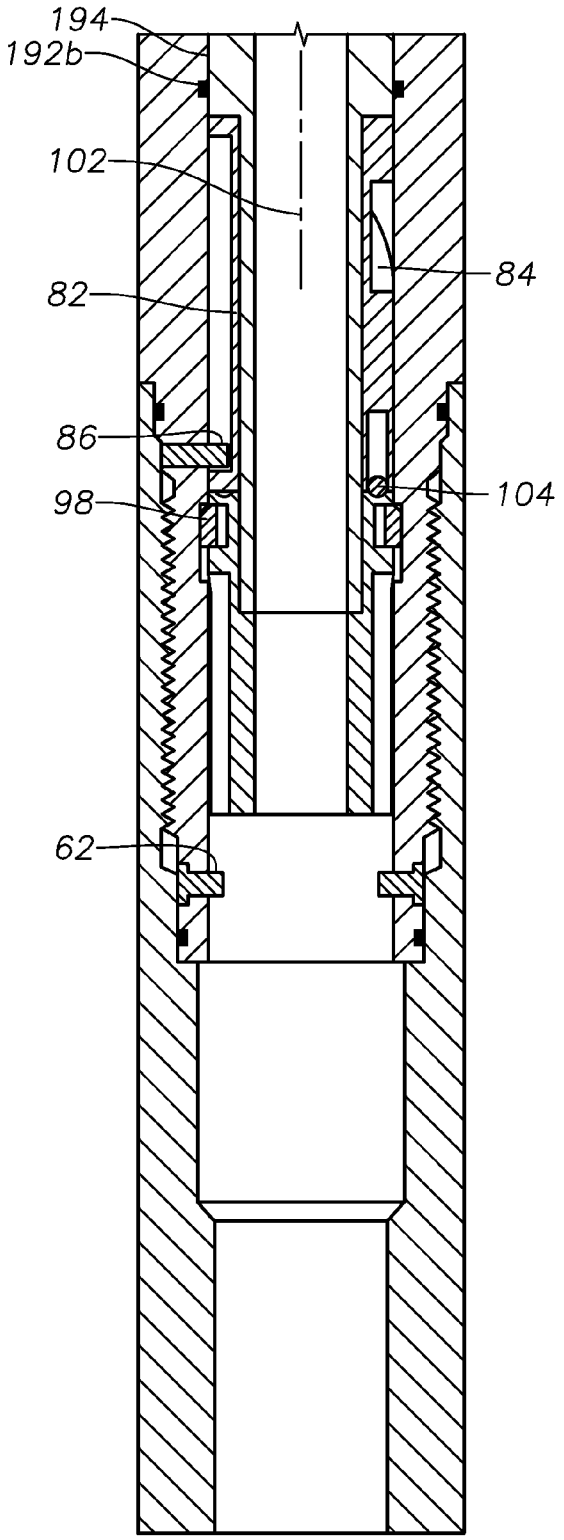

Referring now to FIGS. 7A-7D, partial cross-sectional sequential views of the embodiment of FIGS. 6A-6D with a continuous flow through bore to a hydraulically set down hole tool, such as a whipstock assembly, will now be described. The sequence of FIGS. 7A-7D represent the position when the releasing leg 110*g* (as seen in FIG. 4B) has been reached. Hence, as seen in FIGS. 7A-7D, the spring 190 has allowed the piston 152 and jet member 158 to travel upward (i.e. toward the surface). The spring lock 180 has expanded because the spring lock 180 has traveled into the expanded bore 128, allowing the spring lock 180 to bias circumferentially outward, which disengages the jet member 158 from the spring lock 180 thereby allowing the jet 172 to pivot into a collapsed position via the hinge 174 as seen in FIG. 7B. In other words, the internal projection 126 has engaged the pivot jet 172, allowing the pivoting of the jet 172 into the recessed position within the inner shell 162, which allows for a continuous flow path from the bore 124 of the top sub 121, through the inner shell bore 188 and into the bore of the mandrel 140, and ultimately to the whipstock, and/or other down hole tools, in order to supply the whipstock and/or other down hole tools with hydraulic pressure. As seen in FIGS. 7A-7D, the flow F has a direct path to the tools below. Note that the circulation port 148 is isolated from communication with the annular port 150 via the seal 192*a* on the seal sub 193, wherein the seal sub 193 is disposed about the mandrel 140, and wherein the seals 192*a*/192*b* are sealingly engaging the enlarged outer diameter surface 194 of the mandrel 140.

Referring now to FIG. 8, a perspective view of the spring lock 180 is illustrated, wherein the spring lock 180 contains a cylindrical wall 200 that extends to the radial surface 204 as previously mentioned. FIG. 8 also illustrates that the spring lock 180 contains multiple tabs, or segments 206*a*, 206*b*, 206*c*, 206*d*, 206*e*, 206*f*, 206*g*, 206*h*, 206*i*, 206*j*, 206*k*, 206*l*, 206*m*, 206*n*. The multiple segments 206*a* through 206*n* are separated by a distance, such as illustrated by distance 208. As an example in one embodiment, the outer diameter of the wall 200 is approximately 4.0", and the gap 202 is approximately 0.13". Additionally, the spring lock 180 contains indented portions such as the portions seen at 210*a* and 210*b*. The multiple tabs will be connected via an arm, such as arm 212, to the cylindrical wall 200. With the multiple segments, as well as the indentations, there is also provided two cylindrical openings in the segments 206*a* and 206*n*, denoted by the opening 214 and the opening 216. In one embodiment, by allowing the distance of 208 between the multiple segments, as well as the indentations and the openings, and the gap 202, the spring lock 180 acts as a biasing means that can be contracted and expanded along the circumference of the cylindrical wall 200.

Figure 9:
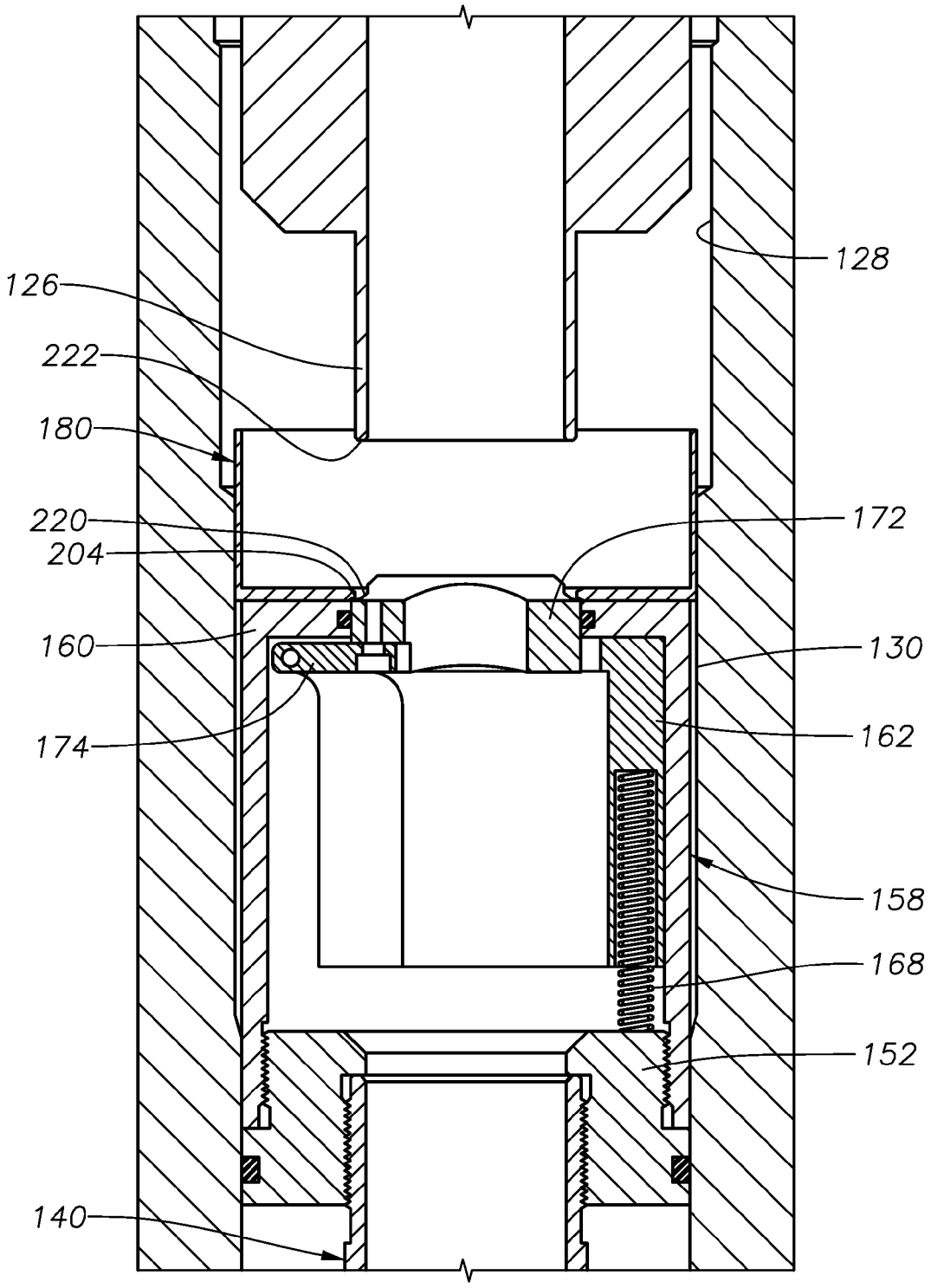
FIG. 9 is an enlarged view of the jet member denoted in the area "A" seen in FIG. 5A.

FIG. 9 is an enlarged view of the jet member 158 and other elements denoted in the area "A" seen in FIG. 5B. More specifically, FIG. 9 depicts the expanded bore 128 and the reduced bore 130. The spring lock 180 is engaged by the reduced bore 130, and therefore, the radial surface 204 is engaging the indentation 220 of the pivot jet 172. The spring lock 180 holds the pivot jet 172 in the position seen in FIG. 9. In this way, the pivot jet 172 is in place to provide the choke, and wherein the pivot jet 172 has the hinge 174 connected to the inner shell 162 as previously described. The internal projection 126, and in particular the radial end surface 222, will cooperate and engage the indentation 220 with upward movement of the piston 152 and mandrel 140 to pivot the jet 172 into the inner shell 162, as seen in FIG. 7B. Returning to FIG. 9, the spring 168 is depicted, wherein the spring 168 biases the inner shell 162 into engagement with the outer shell 160, and wherein the outer shell 160 is threadedly attached to the piston 152.

Figure 10:
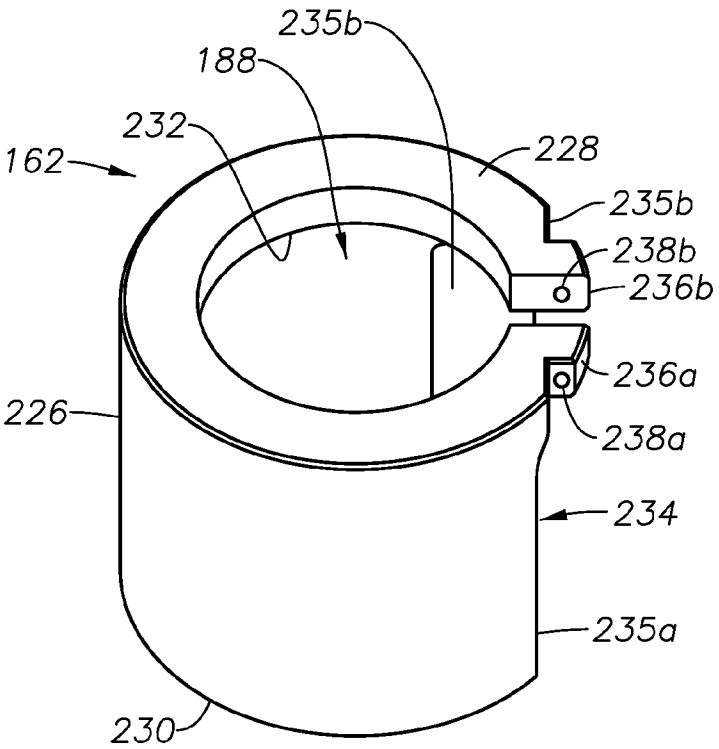
FIG. 10 is an enlarged perspective view of one embodiment of the inner shell.

FIG. 10 is a perspective view of the inner shell 162. In one preferred embodiment, FIG. 10 depicts that the inner shell 162 which is generally cylindrical, and more specifically, the inner shell 162 has an outer cylindrical surface 226 that has at one end a rim surface 228 and at the other end the radial surface 230, wherein the rim surface 228 will have a lip portion 232. The inner shell 162 has an inner portion that contains the bore 188, previously noted. The outer cylindrical surface 226 has a cut-out section seen generally at 234. More particularly, FIG. 10 depicts the cut-out face 235*a* and cut-out face 235*b*. Extending from the rim surface 228 is the hinge receptacle 236*a* and the complimentary hinge receptacle 236*b*, wherein the hinge receptacle 236*a* contains the opening 238*a* and the hinge receptacle 236*b* contains the opening 238*b*, and wherein the hinge pin (not seen here) will be positioned within the openings 238*a*, 238*b* for pivoting of the hinge. As noted earlier, the jet 172 is allowed to pivot into the cut-out section 234 thereby allowing for an open inner bore 188.

Figure 11:
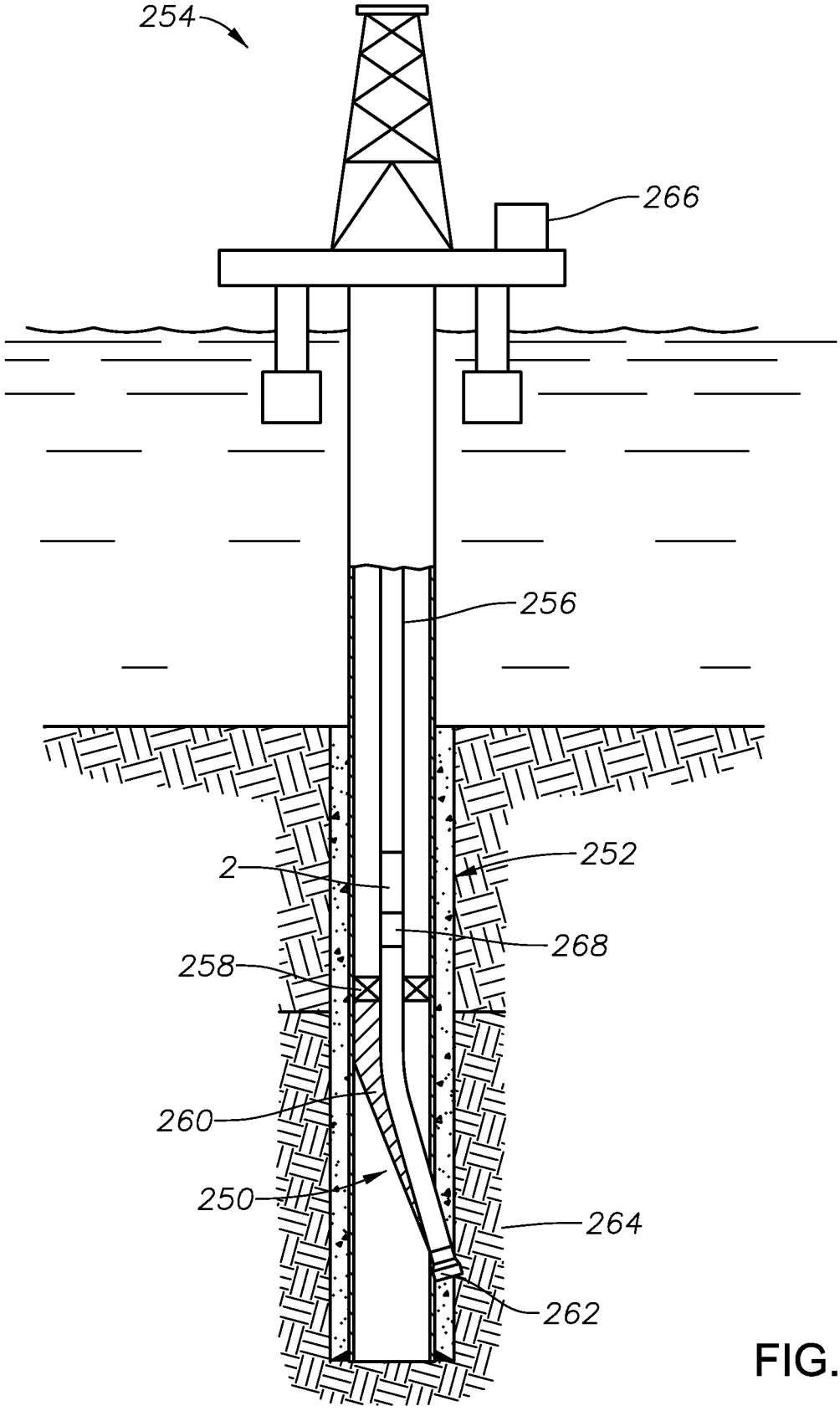
FIG. 11 is a schematic illustration of one embodiment of the apparatus in a wellbore.

Referring now to FIG. 11, a schematic illustration of the apparatus 2 and down hole tool 250 (such as whipstock assembly 250) of the present disclosure being positioned into a wellbore 252 from a floating rig 254 will now be described. As well understood by those of ordinary skill in the art, the operator makes up the work string 256, which may be a drill pipe or some other type of tubular at the surface with the apparatus 2 and whipstock assembly 250, and runs the work string into the wellbore 252.

The whipstock assembly 250 is attached to the apparatus 2 which in turn is attached to the work string 256, and wherein the whipstock assembly 250 will include an anchor/packer device 258 for anchoring onto the wellbore 252. The wellbore 252 is filled with a drilling fluid. The anchor/packer device 258 is generally a hydraulically set tool.

Also, whipstock assembly 250 will contain the slanted face whipstock surface 260 and the cutter/drill bit 262. The cutter/drill bit 262 is used to mill the window into the wellbore 252 (wherein the wellbore 252 may be casing cemented into a drilled bore hole) and drill the bore hole into a formation 264. Whipstock assemblies are commercially available from Knight Oil Tools, Inc. under the name X-1. The anchor/packer device is also commercially available from Knight Oil Tools, Inc. under the name Anchor/Packer. FIG. 11 also depicts the surface fluid pump 266 for pumping fluids into the wellbore 252. Generally the fluid pump 266 is connected to the work string 256.

As previously noted, the MWD tool 268, which is also attached to the work string 256, will have fluid pumped there through. The MWD tool 268 will have various sensors as is well known in the art. During operation, the MWD tool 268 will collect data measurement of the position and orientation of the whipstock assembly which will be telemetered to the surface. In one embodiment, the telemetry of the data is accomplished with pressure pulses. MWD tools are commercially available from Schlumberger, Inc. under the name Path Finder MWD.

An aspect of one embodiment herein disclosed is that the whipstock assembly's position and orientation can be computed and later reconfirmed. Another aspect of one disclosed embodiment is the supplying of sufficient hydraulic pressure in order to set the anchor/packer of the whipstock assembly. The supplying of sufficient hydraulic pressure is due in part to the large flow area provided by the apparatus herein disclosed. Yet another aspect of one embodiment is that the operator will run in the hole with the circulation and annular ports open for several predetermined cycles before the ports are closed. Still yet another aspect of one embodiment is that the collet is optional in that only the spring member may be used to bias the mandrel.

Another aspect is that in one embodiment a down hole valve is disclosed. The down hole valve can be used to set specific tools such as lateral well window locators, a packers, or hangers. Yet another aspect is that the down hole valve can be controlled (opened and closed) by applying a predetermined set amount of flow rate through the work string. Still yet another aspect is that the guide path on the guide bushing can be designed to allow specialized opening and closing sequences specific to the attached down hole tool.

Although the present invention has been described in considerable detail with reference to certain preferred versions thereof, other versions are possible. Therefore, the spirit and scope of the appended claims should not be limited to the description of the preferred versions contained herein.

I claim:

1. A valve apparatus for circulating fluid in a wellbore filled with fluid, wherein the valve apparatus is attached to a work string, the valve apparatus comprising:

a housing fluidly connected to the work string, said housing having an internal portion having a guide pin, and wherein said internal portion contains a reduced bore and an expanded bore;

a mandrel concentrically disposed within said internal portion of said housing, said mandrel having a piston attached at a first end of the mandrel and a mandrel cap attached at a second end of the mandrel, and wherein said mandrel contains a circulation port and a jet member pivotally attached to said piston, said jet member operatively configured to receive the fluid and create a pressure force during fluid flow through said housing;

a spring lock operatively attached to said jet member, said spring lock engaging said reduced bore of said housing so that said spring lock holds said jet member;

a guide bushing disposed about said mandrel, said guide bushing having a predetermined guide path contained on said guide bushing and wherein said predetermined guide path is operatively associated with the guide pin, said guide path including a releasing leg;

wherein said spring lock moves into said expanded bore once the releasing leg is reached on said guide path so that said spring lock expands thereby allowing said jet member to pivot so that a continuous flow path is formed through the apparatus.

2. The valve apparatus of claim 1 wherein said jet member includes:

an outer shell attached to said piston;

an inner shell disposed within said outer shell;

a jet pivotally hinged to said inner shell.

3. The valve apparatus of claim 2 wherein said housing contains an internal projection, and said internal projection will engage said pivoting jet thereby forming the continuous flow path through the valve apparatus.

4. The apparatus of claim 3 further comprising a lock ring positioned about said mandrel cap, said lock ring operatively configured to engage an indentation formed on the internal portion of said housing so that once said lock ring expands into said indentation, said lock ring locks the mandrel from movement relative to the housing in the forward or reverse direction.

5. The apparatus of claim 4 wherein said mandrel cap contains a track and wherein said internal portion of said housing contains a track pin, and wherein said track and said track pin cooperate to allow movement of said mandrel in the forward and reverse direction.

6. The apparatus of claim 4 further comprising internal seals on said internal portion of said housing that cooperate and engage with an enlarged seal surface on an outer portion of said mandrel for preventing communication from the outer portion of the housing to the internal portion of the housing.

7. The valve apparatus of claim 4 further comprising an internal seal protector fitted about said mandrel in order to protect the internal seal from damage during axial movement of said mandrel.

8. The valve apparatus of claim 4 further comprising a ball and a ball spring operatively associated with a first end of said guide bushing, said ball spring biasing said ball into engagement with said first end of said mandrel cap so that said guide bushing is engaged with said mandrel.

9. A method of positioning and orienting a whipstock assembly in a wellbore filled with fluid, the whipstock assembly being connected to a work string, the method comprising:

a) providing an apparatus being connected at a first end to the work string and at a second end to the whipstock assembly, said apparatus including a housing fluidly connected to the work string, said housing having an internal portion and an annular port there through; a mandrel concentrically disposed within said internal portion of said housing, and wherein said mandrel contains a circulation port; a spring disposed about said mandrel and biasing said mandrel in a forward direction; a guide bushing disposed about said mandrel, said guide bushing having means for radially rotating said guide bushing;

b) placing the work string with attached whipstock assembly in the wellbore;

c) activating a fluid pump at the surface so that the fluid is pumped through the apparatus so that said spring is compressed thereby allowing said mandrel to move in a reverse direction so that said circulation port fully aligns with said annular port allowing fluid communication there through;

d) circulating fluid through the circulation ports on the mandrel and the annular port on the housing;

e) operating a measurement while drilling (MWD) tool located in the work string with the circulation of fluid;

f) obtaining a first set of MWD data measurements from the MWD tool, wherein the first set of MWD data measurements are related to the location and position of the whipstock assembly in the wellbore;

g) deactivating the fluid pump so that fluid is no longer pumped;

h) biasing the mandrel with the spring in the forward direction so that said circulation port and said annular port are no longer fully aligned;

i) cycling the radial rotating means on said guide bushing;

j) positioning and orienting the whipstock assembly utilizing the first set of MWD data measurements.

10. The method of claim 9 further comprising:

k) activating the fluid pump at the surface so that the fluid is pumped through the apparatus so that said spring is compressed thereby allowing said mandrel to move in a reverse direction so that said circulating port fully aligns with said annular port allowing fluid communication there through;

l) obtaining a second set of MWD data measurements related to the location and position of the whipstock in the wellbore;

m) deactivating the fluid pumps so that fluid is no longer pumped;

n) biasing the mandrel with the spring in the forward direction so that said circulation port and said annular port are no longer fully aligned;

o) cycling the radial rotating means on said guide bushing;

p) adjusting the position and orientation of the whipstock assembly of step (j) utilizing the second set of MWD data measurements;

q) activating the fluid pumps at the surface so that the fluid is pumped through the apparatus and obtaining a third set of MWD data measurements;

r) reconfirming the position and orientation of the whipstock.

11. The method of claim 10 wherein said mandrel contains a pivoting jet member, and said housing contains an internal projection, and the method further comprises forming a continuous flow path to the whipstock assembly by engaging said internal projection with said pivoting jet member so that the continuous flow path is formed.

12. The method of claim 11 wherein the step of cycling the radial rotating means on said guide bushing includes a guide pin on the internal portion of said housing engaging a leg on said guide bushing so that the mandrel can travel in the forward and reverse direction.

13. The method of claim 12, wherein the apparatus contains a lock ring disposed about said mandrel and the method further includes:

s) expanding said lock ring into an indentation on said internal portion of said housing so that said mandrel is prevented from movement in the forward or reverse direction.

14. The method of claim 11 wherein the step of cycling the radial rotating means includes engaging a guide pin from the internal housing within radial grooves on said guide bushing and pumping fluid from the surface so that said guide bushing is radially rotated as the guide pin traverses the radial grooves.

15. The method of claim 11 wherein said radial rotating means comprises a preselected guide path on said guide bushing operatively associated with a guide pin on the internal portion of said housing, wherein said preselected guide path contains seven (7) cycles.

16. The method of claim 10 wherein said apparatus further comprises a collet member disposed about said mandrel, said collet member having a latch end engaging said mandrel; said spring operatively disposed within said collet member, said spring biasing said collet member in a direction away from said mandrel; and the method further comprises:

s) cycling the radial rotating means to a releasing leg on said guide bushing;

t) biasing the mandrel in forward direction with the spring so that the circulating ports on the mandrel are no longer in communication with the annular ports on the housing;

u) releasing the latch end of said collet member from said mandrel;

v) abutting the mandrel with the inner bore of the work string so that a continuous flow path to the whipstock assembly is established;

w) activating the pumps so that fluid is pumped from the work string to the whipstock assembly;

x) hydraulically setting the whipstock assembly within the wellbore.

17. The method of claim 10 wherein the guide bushing contains radial grooves and the step of pumping fluid includes pumping the fluid through a choke positioned within said piston, said choke operatively configured to create a pressure force during fluid flow through the apparatus and to move said mandrel longitudinally along a mandrel axis so that said guide bushing is radially rotated as the guide pin traverses the radial grooves.

18. A valve apparatus for controlling fluid to a down hole tool in a wellbore filled with fluid, wherein the apparatus is attached to a work string, the valve apparatus comprising:

a housing fluidly connected to the work string, said housing having an internal portion having a guide pin;

a mandrel concentrically disposed within said internal portion of said housing, said mandrel having a piston attached at a first end of the mandrel and a mandrel cap attached at a second end of the mandrel, and wherein said mandrel contains a circulation port and a choke positioned within said piston, said choke operatively configured to receive the fluid and create a pressure force during fluid flow through said choke;

a guide bushing disposed about said mandrel, said guide bushing having a predetermined guide path contained on said guide bushing and wherein said predetermined guide path is operatively associated with the guide pin;

a collet member disposed about said mandrel, said collet member having a latch end engaging said piston.

19. The valve apparatus of claim 18 further comprising a lock ring positioned about said mandrel cap, said lock ring operatively configured to engage an indentation formed on the internal portion of said housing so that once said lock ring expands into said indentation, said lock ring locks the mandrel from movement relative to the housing in the forward or reverse direction.

20. The valve apparatus of claim 19 wherein said mandrel cap contains a track and wherein said internal portion of said housing contains a track pin, and wherein said track and said track pin cooperate to allow movement of said mandrel in the forward and reverse direction.

21. The valve apparatus of claim 20 wherein said housing contains a flow aperture and said piston contains a plurality of openings offset from a center axis of said piston and wherein in an abutting position of the mandrel with an inner bore of the work string so that said flow aperture and said plurality of openings forms a continuous fluid path to the down hole tool and the fluid pressure created by the pumps is transmitted to the down hole tool.

22. The valve apparatus of claim 21 further comprising internal seals on said internal portion of said housing that cooperate and engage with an enlarged seal surface on an outer portion of said mandrel for preventing communication from the outer portion of the housing to the internal portion of the housing.

23. The valve apparatus of claim 22 further comprising an internal seal protector fitted about said mandrel in order to protect the internal seal from damage during axial movement of said mandrel.

24. The valve apparatus of claim 23 further comprising a ball and a ball spring operatively associated with a first end of said guide bushing, said ball spring biasing said ball into engagement with said first end of said mandrel cap so that said guide bushing is engaged with said mandrel.

25. A method for positioning and orienting a down hole tool in a wellbore filled with fluid, the down hole tool being connected to a work string, the method comprising:

a) providing an apparatus being connected at a first end to the work string and at a second end to the down hole tool, said apparatus including a housing fluidly connected to the work string, said housing having an internal portion and an annular port there through; a mandrel assembly concentrically disposed within said internal portion of said housing, and wherein said mandrel assembly contains a circulation port; a pivoting jet positioned on said mandrel assembly; a spring disposed about said mandrel and biasing said mandrel in a forward (i.e. upward) direction; a guide bushing disposed about said mandrel, said guide bushing having means for radially rotating said guide bushing;

b) placing the work string with attached down hole tool in the wellbore;

c) activating a fluid pump at the surface so that the fluid is pumped through the apparatus so that said spring is compressed thereby allowing said mandrel assembly to move in a reverse direction so that said circulating port fully aligns with said annular port allowing fluid communication there through;

d) circulating fluid through the circulating port on the mandrel assembly and the annular port on the housing;

e) operating a measurement while drilling (MWD) tool located in the work string with the circulation of fluid;

f) obtaining a first set of MWD data measurements from the MWD tool, wherein the first set of MWD data measurements are related to the location and position of the down hole tool in the wellbore;

g) deactivating the fluid pump so that fluid is no longer pumped;

h) biasing the mandrel with the spring in the forward direction so that said circulation port and said annular port are no longer fully aligned;

i) cycling the radial rotating means on said guide bushing;

j) positioning and orienting the down hole tool utilizing the first set of MWD data measurements;

k) activating the fluid pump at the surface so that the fluid is pumped through the apparatus so that said spring is compressed thereby allowing said mandrel to move in a reverse direction so that said circulating port fully aligns with said annular port allowing fluid communication there through;

l) obtaining a second set of MWD data measurements related to the location and position of the down hole tool in the wellbore;

m) deactivating the fluid pumps so that fluid is no longer pumped;

n) biasing the mandrel with the spring in the forward direction so that said circulation port and said annular port are no longer fully aligned;

o) cycling the radial rotating means on said guide bushing;

p) adjusting the position and orientation of the down hole tool of step (j) utilizing the second set of MWD data measurements;

q) activating the fluid pumps at the surface so that the fluid is pumped through the apparatus and obtaining a third set of MWD data measurements;

r) reconfirming the position and orientation of the down hole tool;

s) cycling the radial rotating means to a releasing leg on said guide bushing;

t) forming a continuous flow path by engaging an internal projection on said housing with said pivoting jet member so that the continuous flow path is formed.

* * * * *